US011261621B2

(12) United States Patent
Lai

(10) Patent No.: US 11,261,621 B2
(45) Date of Patent: Mar. 1, 2022

(54) INTEGRATED ZIPPER LOCK

(71) Applicant: THE SUN LOCK COMPANY, LTD., Tuen Mun (HK)

(72) Inventor: Karl Lai, Tai Po (HK)

(73) Assignee: THE SUNLOCK COMPANY, LTD., Tuen Mun (HK)

( * ) Notice: Subject to any disclaimer, the term of this patent is extended or adjusted under 35 U.S.C. 154(b) by 500 days.

(21) Appl. No.: 16/285,313

(22) Filed: Feb. 26, 2019

(65) Prior Publication Data

US 2019/0301201 A1 Oct. 3, 2019

Related U.S. Application Data

(60) Provisional application No. 62/689,511, filed on Jun. 25, 2018, provisional application No. 62/649,851, filed on Mar. 29, 2018.

(51) Int. Cl.
*E05B 37/00* (2006.01)
*E05B 65/52* (2006.01)
(Continued)

(52) U.S. Cl.
CPC ..... *E05B 37/0034* (2013.01); *E05B 19/205* (2013.01); *E05B 37/0058* (2013.01);
(Continued)

(58) Field of Classification Search
CPC ..... E05B 37/00; E05B 37/02; E05B 37/0034; E05B 37/0058; E05B 19/205; E05B 65/52; E05B 35/105
(Continued)

(56) References Cited

U.S. PATENT DOCUMENTS 6,065,313 A * 5/2000 Huang ..... A44B 19/301 70/316
6,568,225 B1 * 5/2003 Chang ..... E05B 37/12 70/333 R
(Continued)

FOREIGN PATENT DOCUMENTS

CN 201141245 Y 10/2008
CN 202718476 U 2/2013
(Continued)

OTHER PUBLICATIONS

Office Action, Chinese Patent Application No. 2019800208138, dated May 18, 2021 (10 pages).
(Continued)

*Primary Examiner* — Suzanne L Barrett
(74) *Attorney, Agent, or Firm* — Ware, Fressola, Maguire & Barber LLP

(57) ABSTRACT

A zipper lock has two locking members to secure two zipper pulls of a suitcase and a control plate to cause the locking member to disengage from the zipper pulls. The lock has a latch engaged with the control plate, the latch positionable in a first latch position when the lock is in a locked mode or in a second latch position to open the lock. The lock has a combination mechanism using dials and clutches to control the movement of a spindle which allows the latch to move the second latch position when the arrangement of the dials matches the correct combination code. The lock also has a key-overriding mechanism using a cylinder to cause the movement of the latch when a correct key is used to turn the cylinder to open the lock. A recovery mechanism allows a user to recover the lost combination code.

19 Claims, 19 Drawing Sheets

(51) Int. Cl.
*E05B 19/20* (2006.01)
*E05B 37/02* (2006.01)
*E05B 35/10* (2006.01)

(52) U.S. Cl.
CPC ..... *E05B 37/02* (2013.01); *E05B 65/52* (2013.01); *E05B 35/105* (2013.01)

(58) Field of Classification Search
USPC ..... 70/18, 58, 67–69, 284, 285
See application file for complete search history.

(56) References Cited

U.S. PATENT DOCUMENTS 6,807,832 B1 * 10/2004 Jeng ..... E05B 37/12 190/101
7,415,853 B2 * 8/2008 Yu ..... E05B 37/02 70/21
7,467,529 B1 * 12/2008 Lai ..... E05B 35/105 70/18
8,096,150 B2 * 1/2012 Lai ..... A44B 19/301 70/21
8,113,024 B2 * 2/2012 Yang ..... E05B 37/0034 70/284
8,161,778 B1 * 4/2012 Ma ..... E05B 35/10 70/21
8,661,861 B2 * 3/2014 Lai ..... E05B 37/0058 70/21
9,745,780 B2 * 8/2017 Chen ..... E05B 47/0603
9,809,998 B2 * 11/2017 Lai ..... E05B 65/52
10,041,274 B2 * 8/2018 Lai ..... E05B 37/0034
2013/0036778 A1 2/2013 Lai
2013/0091906 A1 * 4/2013 Chen ..... E05B 65/52 70/68

FOREIGN PATENT DOCUMENTS

CN 202866465 U 4/2013
CN 103147638 A 6/2013
CN 203050266 U 7/2013
CN 103850538 A 6/2014
CN 203755846 U 8/2014
CN 104088531 A 10/2014
CN 104265091 A 1/2015
CN 204609537 U 9/2015
CN 106014006 A 10/2016
CN 106401317 A 2/2017
CN 106545227 A 3/2017
CN 206888735 U 1/2018
JP 2010048072 A 3/2010

OTHER PUBLICATIONS

International Search Report, International Patent Application No. PCT/CN2019/079250, dated Jun. 21, 2019 (5 pages).

* cited by examiner

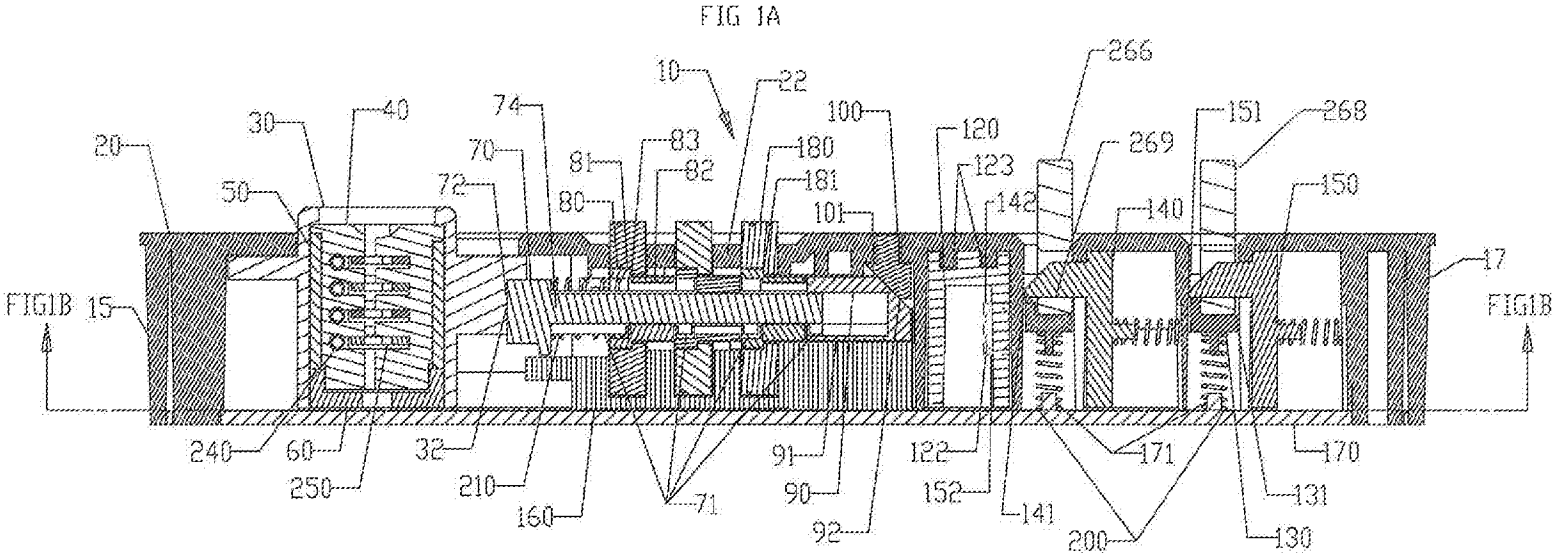
FIG 1A
FIG1B
FIG1B
10
15
17
20
22
30
31
32
40
50
60
70
71
72
74
80
81
82
83
90
91
92
100
101
120
122
123
130
131
140
141
142
150
151
152
160
170
171
180
181
200
210
240
250
266
268
269
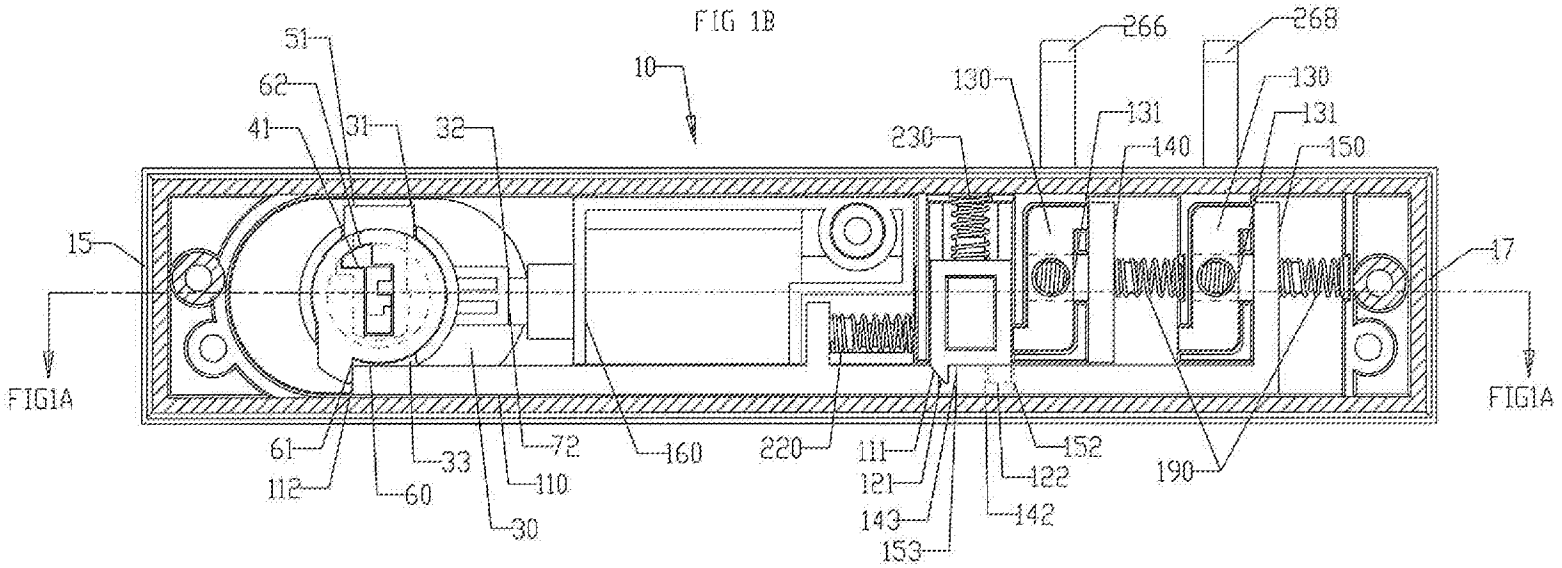
FIG 1B
FIG1A
FIG1A
10
15
17
30
31
32
33
41
51
60
61
62
72
110
111
112
121
122
130
131
140
142
143
150
152
153
160
190
220
230
266
268

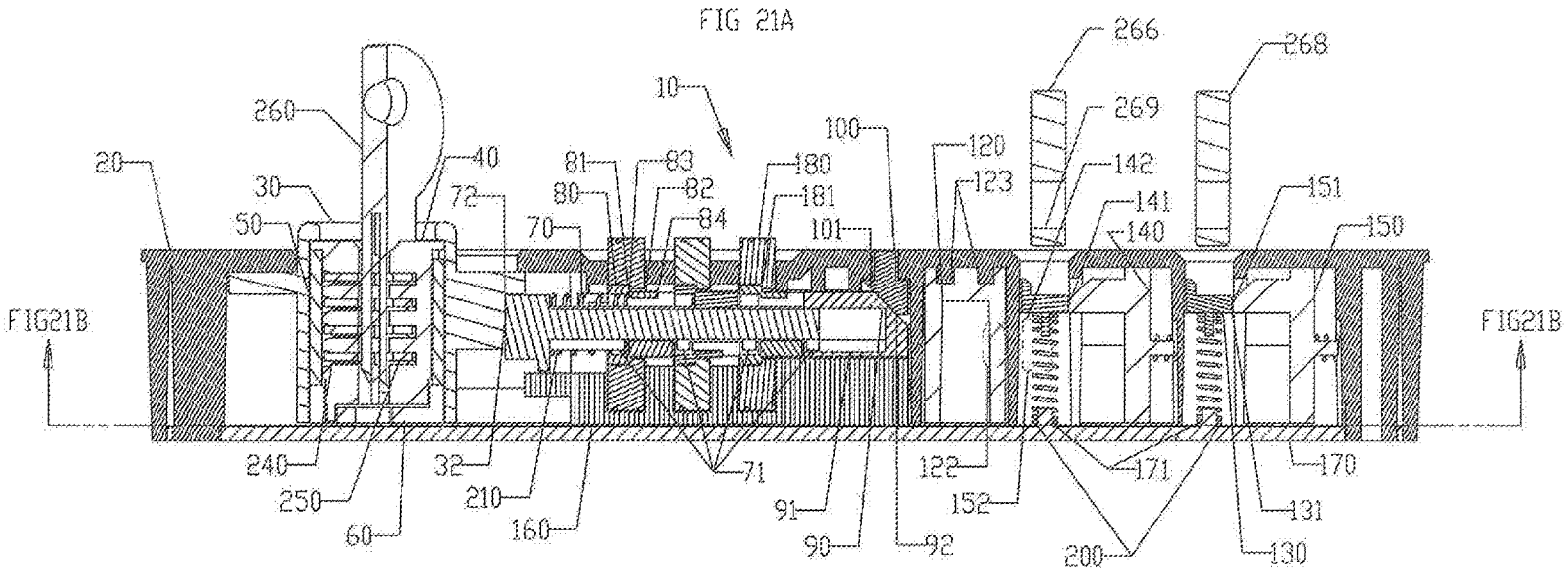
FIG21B
150
151
268
266
269
142
141
140
170
131
130
171
200
120
123
152
122
92
100
101
180
181
91
90
71
10
84
82
83
81
80
70
160
210
32
72
40
60
250
240
260
30
50
20
FIG 21A
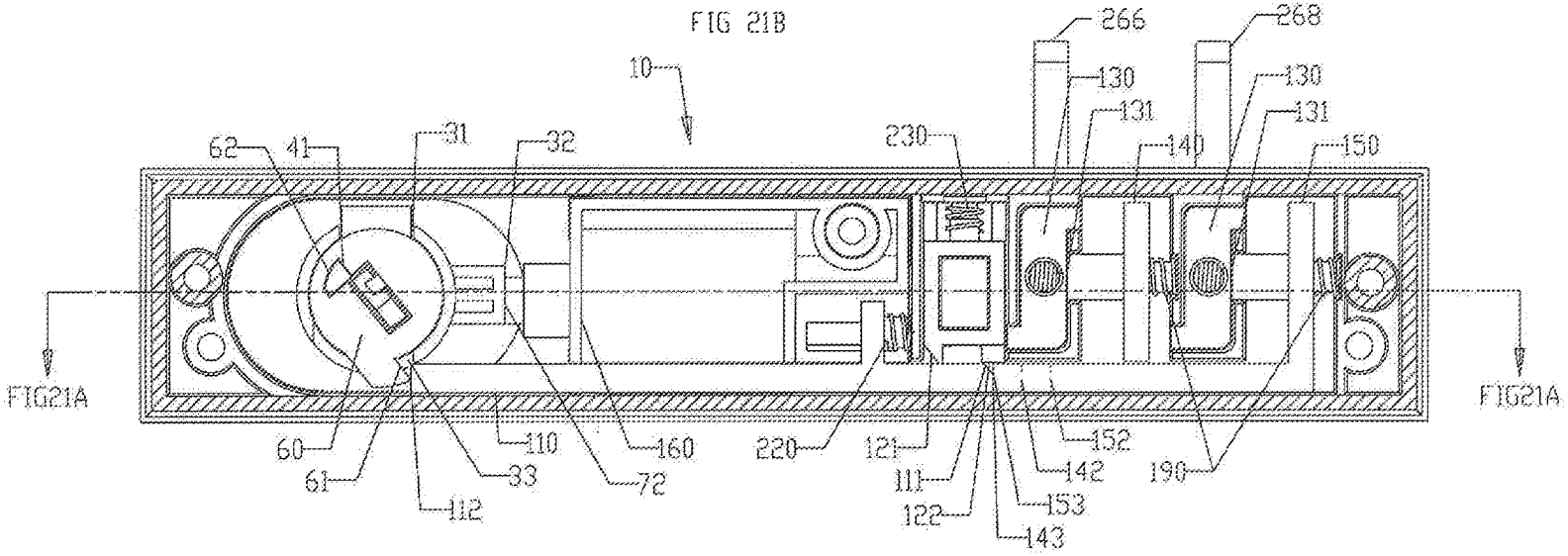
FIG21A
150
268
130
131
140
190
266
152
142
153
143
230
122
111
121
220
10
160
72
32
110
33
31
112
41
61
60
62
FIG 21B

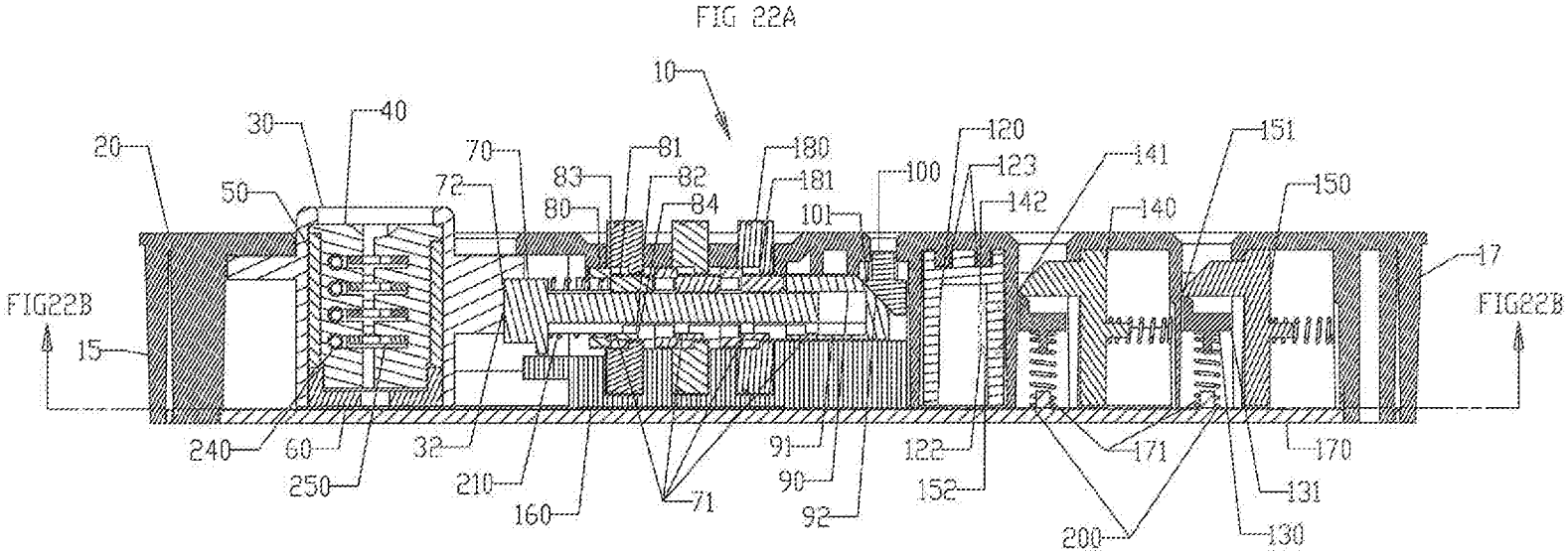
FIG 22A
FIG22B
FIG22B
10
17
150
151
141
140
120
123
142
100
101
180
181
81
82
84
83
80
70
72
40
30
50
20
15
170
131
130
171
200
122
152
91
90
92
71
160
210
32
60
250
240
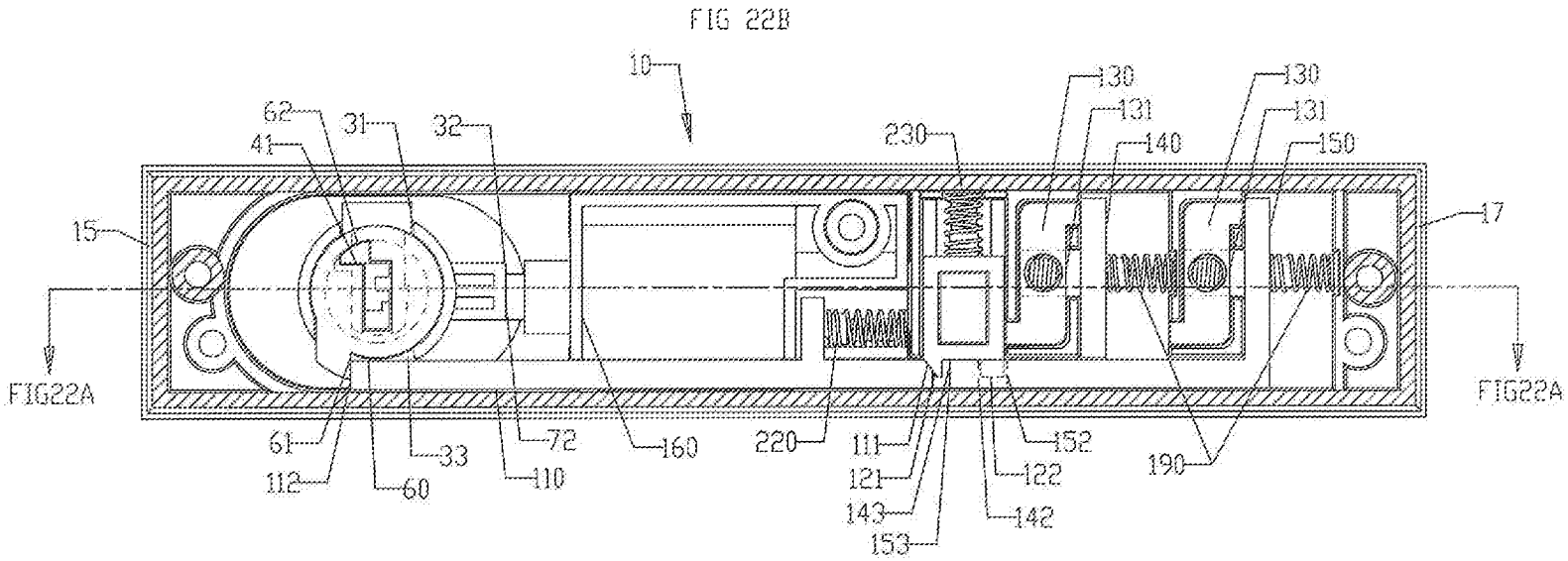
FIG 22B
FIG22A
FIG22A
10
17
130
131
150
140
190
152
122
142
230
111
121
143
153
220
160
72
110
32
33
60
31
62
41
61
112
15

INTEGRATED ZIPPER LOCK

CROSS REFERENCE TO RELATED APPLICATION

This application claims priority to U.S. Provisional Application No. 62/649,851, filed Mar. 29, 2018 and U.S. Provisional Application No. 62/689,511, filed Jun. 25, 2018, which are both hereby incorporated by reference in their entirety.

TECHNICAL FIELD

The present invention is directed to integrated zipper locks which are mounted on a zipper case, where the lock can be opened by a combination mechanism and by a key overriding mechanism.

BACKGROUND OF THE INVENTION

Numerous padlock constructions have been developed and are widely employed by individuals to prevent unauthorized persons from gaining access to a particular item or area which has been closed and locked. Although many locks are constructed to be opened by a key, some combination locks have been designed to be opened by a combination code.

Most constructions of combination padlocks incorporate a J-shaped or U-shaped shackle which is employed to provide the desired engagement with the suitcase or items to be locked. In some applications, the shackle of the lock is inserted through the aperture on the zipper pulls on the suitcase in order to lock the suitcase. In other applications, the lock has two locking heads to separately engage with the zipper pulls. As such, the lock can be integrated with the suitcase.

Currently it is required that all locked items going through customs must allow a customs officer for inspection. Likewise, at a security checkpoint at an airport or the like, the security personnel also have the authority to open a locked item for inspection. It is desirable to provide a padlock for securing zipper pulls to have a key overriding mechanism to allow a security personnel to open the padlock when needed.

SUMMARY OF THE INVENTION

The present invention provides an integrated zipper lock which can be mounted on a zipper case where the lock can be opened by either a combination mechanism or by a key overriding mechanism. The integrated zipper lock has a lock body, a button unit and at least one locking member having a locking head to engage with a zipper pull. The button unit has a button movable in a linear movement controlled by a spindle associated with the combination mechanism. The button unit has a cam moving along with the linear movement of the button. The cam has a rotational movement controlled by a cylinder associated with the key overriding mechanism. Thus, it is an aspect of the prevention to provide a lock, comprising:

a latch movable between a first latch position and a second latch position;

a first locking mechanism operatively coupled to the latch;

a second locking mechanism operatively coupled to the latch; and at least one locking member operatively coupled to the first locking mechanism and the second locking mechanism, wherein the at least one locking member is positionable between a closed position and an open position and configured for positioning in the open position when the latch is in the second latch position, wherein the first locking mechanism and the second locking mechanism are each configured to independently cause the latch to move from the first latch position to the second latch position in a movement direction, and wherein the first locking mechanism comprises at least one clutch and at least one dial associated with said at least one clutch, and a spindle engaged with said at least one clutch, moveable between a first spindle position and a second spindle position in a direction substantially parallel to the movement direction of the latch, wherein when the spindle is positioned in the second spindle position, the latch is allowed to move to the second latch position.

According to an embodiment of the present invention, the lock further comprises:

a control plate operatively coupled to said at least one locking member, the control plate moveable between a first control position and a second control position in a direction substantially perpendicular to the movement direction of the latch, wherein when the control plate is positioned in the first control position, the at least one locking member is prevented from moving to the open position.

According to an embodiment of the present invention, the at least one locking member comprises a locking slot and the control plate comprises a locking member, and wherein when the control plate is positioned in the first control position, the locking member is engaged with the locking slot, and when the control plate is positioned in the second control position, the locking member is released from the locking slot.

According to an embodiment of the present invention, when the latch is caused to move from the first latch position to the second latch position, the control plate is caused to move from the first control position to the second control position and the at least one locking member is also caused to move from the closed position to the open position.

According to an embodiment of the present invention, the at least one locking member comprises a locking head configured to engage with a zipper pull, the locking head positioned in a locking position when the at least one locking member is in the closed position and in a releasing position when the at least one locking member is in the open position, said lock further comprising at least one blocking plate positioned in relationship to the locking head, the at least one blocking plate positionable between a first plate position and a second plate position, wherein when the locking head is moved from the locking position to the releasing position to release the zipper pull, the blocking plate is arranged to move from the first plate position to the second plate position to prevent the locking head from moving to the locking position.

According to an embodiment of the present invention, when the blocking plate is caused by the zipper pull to move from the second plate position to the first plate position, the locking head is arranged to move to the locking position to secure the zipper pull.

According to an embodiment of the present invention, the latch comprises a slope wall and the control member comprises a slope edge, and when the latch is caused to move toward the second latch position, the slope wall of the latch is arranged to apply a force on the slope edge of the control plate, causing the control plate to move from the first control position to the second control position.

According to an embodiment of the present invention, when the control plate is in the second control position, the latch can be caused to move to the second latch position, the at least one locking member is arranged to move from the closed position to the open position.

According to an embodiment of the present invention, said at least one clutch comprises a plurality of clutches forming a stack of clutches, and said at least one dial comprises a plurality of dials, each of the dials associated with a different one of the clutches, and the spindle comprises a spindle shaft and a spindle head connected to one end of the spindle shaft, the spindle shaft having a plurality of extended protrusions, each extended protrusion associated with one of the clutches, and wherein each of the clutches comprises a cylindrical body having a through channel dimensioned to receive the spindle shaft, the cylindrical body further comprising an opening slot formed into the through channel, the opening slot dimensioned to receive the associated extended protrusion, and when the opening slot of each of the clutches is aligned with the associated extended protrusion of the spindle shaft, the spindle is allowed to move from the first spindle position to the second spindle position.

According to an embodiment of the present invention, the cylindrical body of each of the clutches comprises an outer surface having one or more extended fins, and each of the dials comprises a dial inner opening dimensioned to receive the cylindrical body of the associated clutch, each of the dials further comprising a plurality of indents formed on the dial inner opening, the indents dimensioned to engage with said one or more extended fins of the associated clutch so as to allow each of the dials and the associated clutch to rotate together relative to the spindle.

According to an embodiment of the present invention, the lock further comprises a cam movable between a first cam position and a second cam position in a direction substantially parallel to the movement direction of the latch, the cam comprising a cam finger positioned in relationship to the latch, wherein when the spindle is positioned in the second spindle position, the cam can be caused to move from the first cam position to the second cam position and the cam finger is arranged to push the latch to the second latch position.

According to an embodiment of the present invention, the lock further comprises a cam having a cam finger positioned in relationship to the latch, wherein the second locking mechanism comprises a cylinder coupled to the cam for rotation together for moving the cam finger from a first finger position to a second finger position so as to move the latch from the first latch position to the second latch position independently of whether the spindle is positioned in the first spindle position or the second spindle position.

According to an embodiment of the present invention, the cylinder comprises a cylinder tip and the cam further comprises a cam hole dimensioned to receive the cylinder tip to prevent the cylinder from rotation relative to the cam, the cylinder further comprising a plurality of wafers, said lock further comprising a cylinder housing having a housing edge and a plurality of wafer slots, the wafer slots dimensioned to receive the wafers of the cylinder, and a button having a cylinder housing slot and a cam slot, the cylinder housing slot dimensioned to receive the housing edge of the cylinder housing, preventing the cylinder housing from rotation relative to the button, the cam slot arranged for placement of the cam finger, allowing the cam finger to move between the first finger position and the second finger position when the cylinder is caused to rotate, wherein when the wafers are engaged with the wafer slots, the cam is prevented from rotation relative to the button and the cam finger is prevented from moving from the first finger position to the second finger position, and when the wafers are caused to disengage from the wafer slots, the cylinder can be rotated relative to the cylinder housing so as to move the cam finger from the first finger position to the second finger position.

According to an embodiment of the present invention, the spindle comprises a spindle head, and the button further comprises an extended wall arranged to contact with the spindle head so as to move the spindle from the first spindle position to the second spindle position.

According to an embodiment of the present invention, each of the dials comprises a plurality of indicia for forming a combination code such that when the dials are turned to match the combination code to open the lock, the opening slot of each of the clutches is aligned with the associated extended protrusion of the spindle shaft.

According to an embodiment of the present invention, when the opening slot of each of the clutches is aligned with the associated extended protrusion of the spindle shaft, each of the extended protrusions of the spindle is positioned within the opening slot of the associated clutch whether the spindle is positioned in the first spindle position or in the second spindle position, preventing each of the clutches from rotation relative to the spindle shaft, said lock further comprising an end cap positioned adjacent to the stack of clutches, wherein when the spindle is positioned in the first spindle position, the end cap can be caused to move the stack of the clutches relative to the spindle so as to disengage the one or more extended fins of each of the clutches from the indents of the associated dial, so that the dials can be turned independently of the clutches to form a different combination code.

According to an embodiment of the present invention, the lock further comprises a lock body and a base plate fastened to the lock body to accommodate the first locking mechanism and the second locking mechanism, wherein each of the clutches further comprises a decode slot formed on an outer surface of the cylindrical body in relationship to the opening slot, and the base plate comprises a plurality of holes, each hole positioned in relationship to one of the decode slots and dimensioned to receive a picking tool so as to allow the picking tool to separately locate the decode slot of each of the clutches when the dials are turned.

According to an embodiment of the present invention, each of the clutches further comprises a decode slot formed on an outer surface of the cylindrical body in relationship to the opening slot, said lock further comprising a decode fork having a plurality of finger tips, each finger tip associated with and positioned in relationship to one of the decode slots, and wherein when the latch is caused to move from the first latch position to the second latch position by the second locking mechanism, each of the finger tips is caused to press against the outer surface of the associated clutch so as to allow the finger tips to separately located the decode slot of each of the clutches when the dials are turned.

According to an embodiment of the present invention, each of the clutches further comprises an extended finger extended from an outer surface of the cylindrical body in relationship to the opening slot, said lock further comprising a decode fork having a plurality of finger tips, each finger tip associated with and positioned in relationship to one of the extended fingers, and wherein when the latch is caused to move from the first latch position to the second latch position by the second locking mechanism, each of the finger tips is caused to press against the outer surface of the associated clutch so as to allow the finger tips to separately located the extended finger of each of the clutches when the dials are turned.

According to an embodiment of the present invention, the lock further comprises a lock body arranged to accommodate the first locking mechanism and the second locking mechanism, the lock body having a lock surface with two locking-latch openings, each locking-latch opening arranged to receive a zipper pull, and wherein said at least one locking member comprises two locking members each having a lock head to engage with one of the zipper pulls.

BRIEF DESCRIPTION OF THE FIGURES

FIG. 1A is a side cross-sectional view of a zipper lock, according to an embodiment of the present invention.

FIG. 1B is a bottom cross-sectional view of the zipper lock of FIG. 1.

FIG. 21A is a side cross-sectional view of the zipper lock showing the lock in an open mode unlocked by the key-overriding mechanism.

FIG. 21B is a bottom cross-sectional view of the zipper lock as shown in FIG. 21A.

FIG. 22A is a side cross-sectional view showing the lock in a reset mode.

FIG. 22B is a bottom cross-sectional view of the zipper lock of FIG. 22A.

DETAILED DESCRIPTION OF THE INVENTION

Figure 1C:
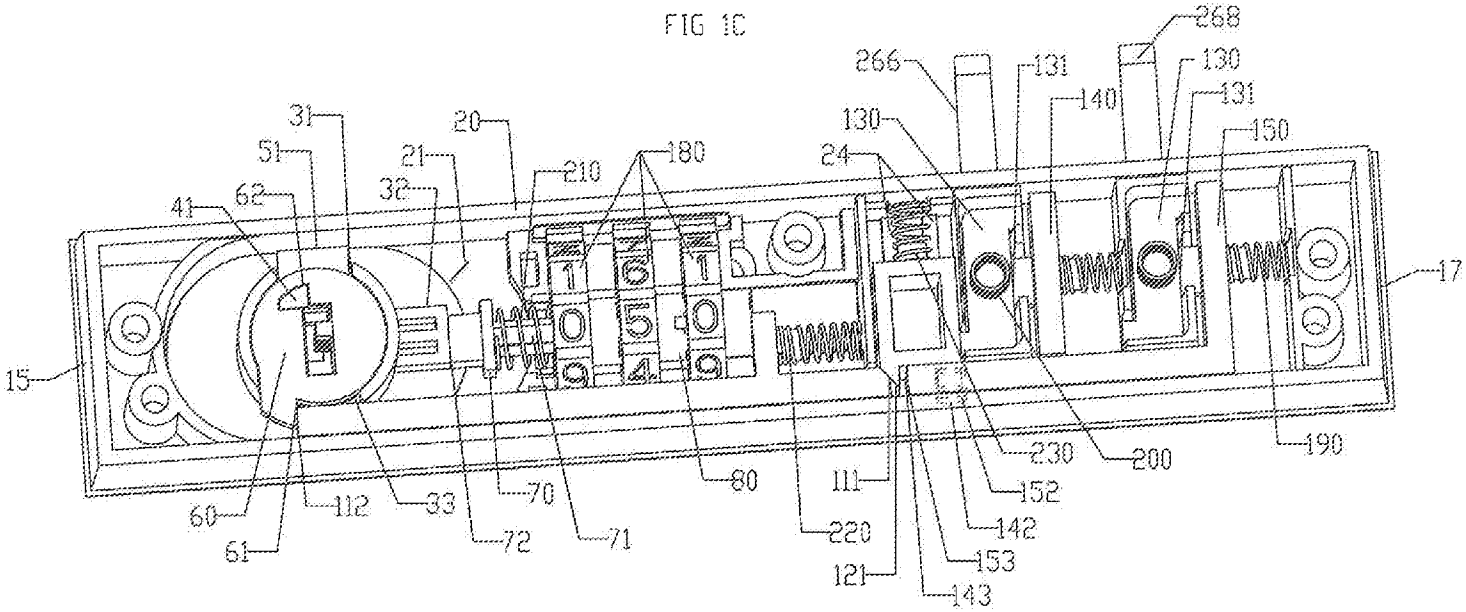
FIG. 1C is a perspective bottom view of the zipper lock with the base plate removed.
Figure 1D:
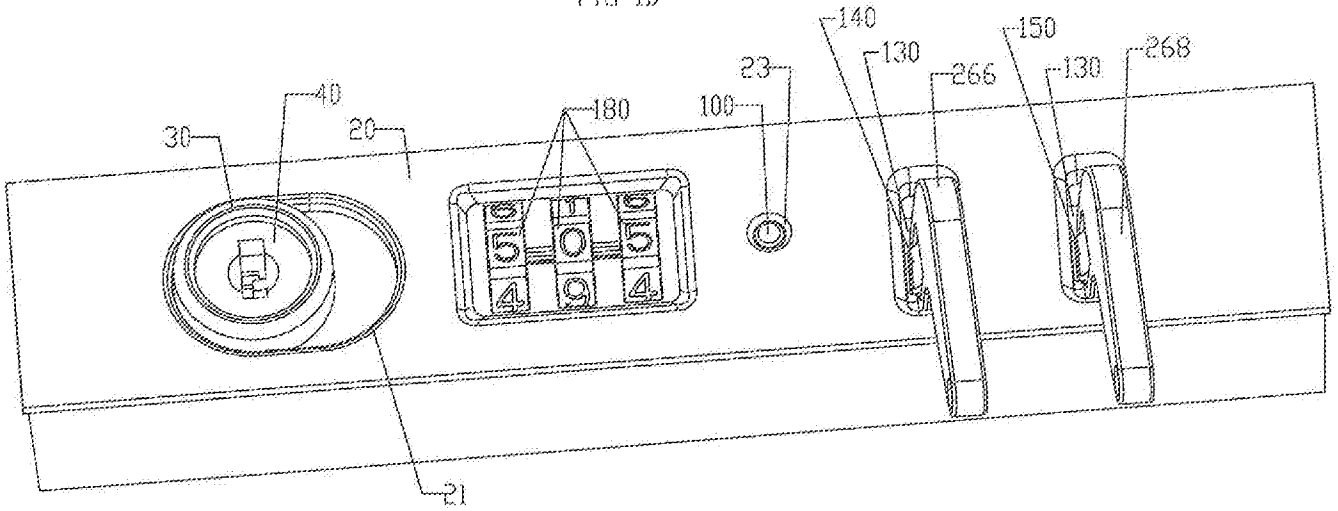
FIG. 1D is a perspective view showing the top part of the zipper lock.
Figure 2:
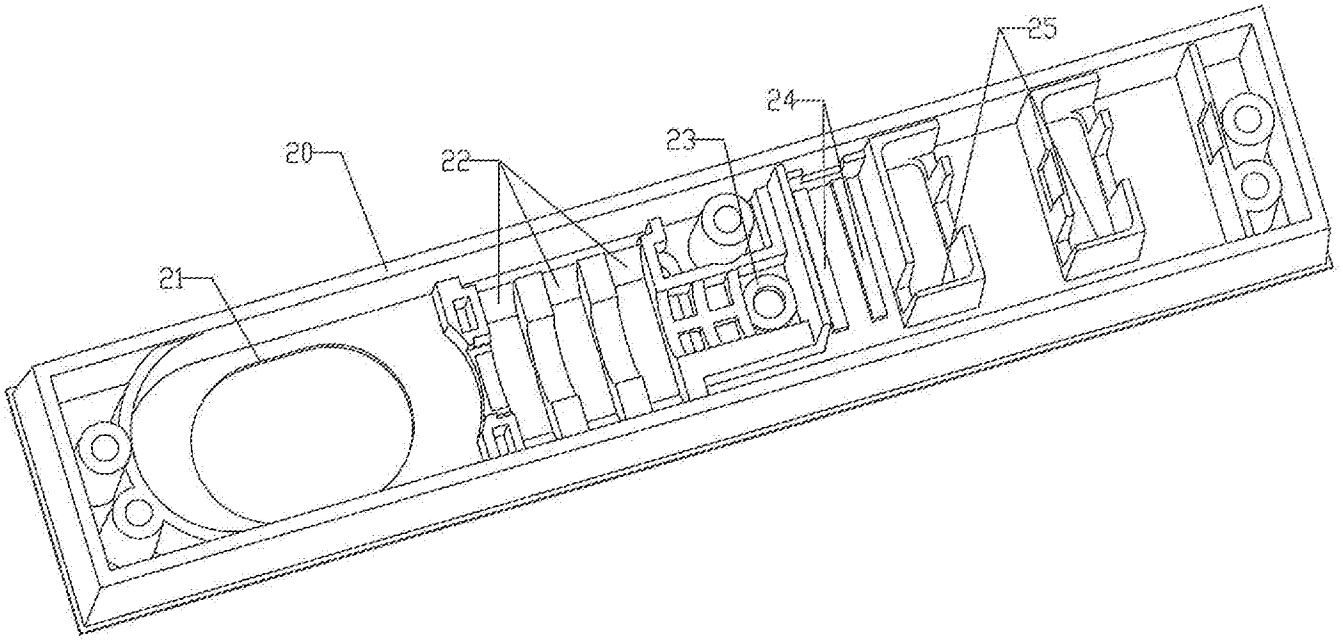
FIG. 2 is a perspective bottom view of a lock body of the zipper lock, according to an embodiment of the present invention.
Figure 3:
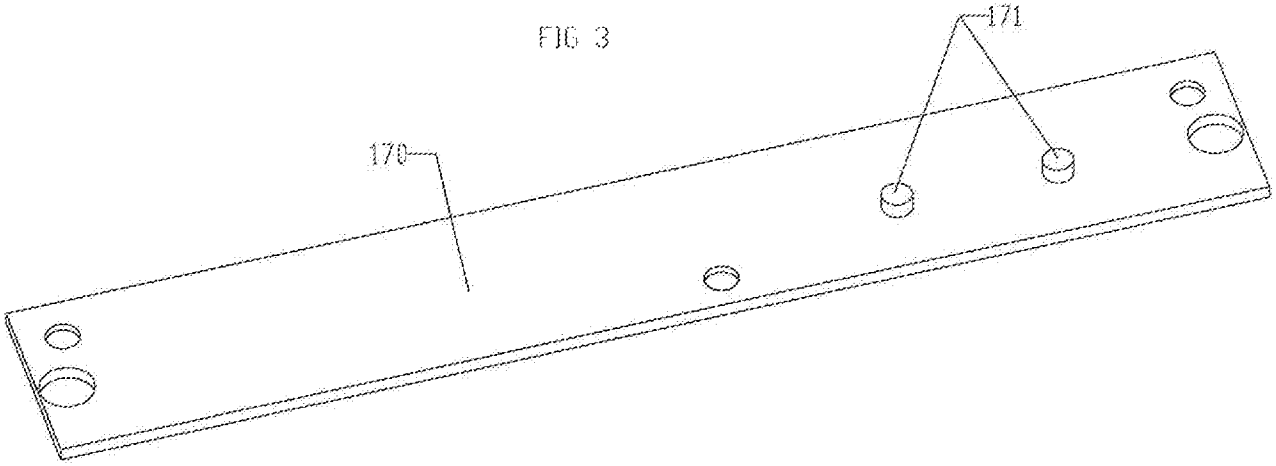
FIG. 3 is a perspective view showing the top side of a base plate, according to an embodiment of the present invention.
Figure 4:
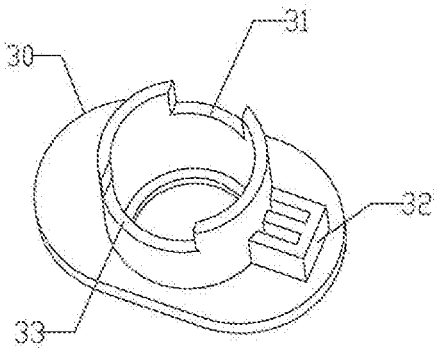
FIG. 4 is perspective view of a button which is part of the zipper lock.
Figure 5:
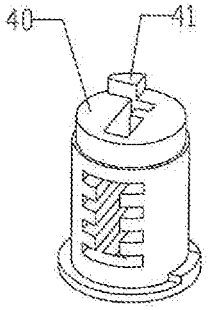
FIG. 5 is a perspective view of a cylinder of the zipper lock.
Figure 6:
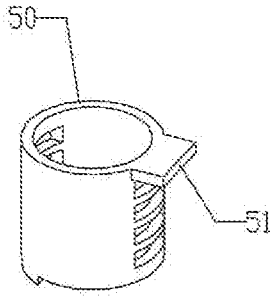
FIG. 6 is a perspective view of a cylinder housing of the zipper lock.
Figure 7:
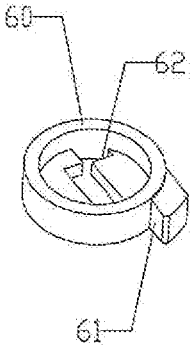
FIG. 7 is a perspective view of a cam of the zipper lock.
Figure 8:
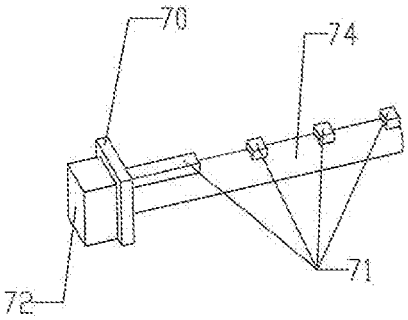
FIG. 8 is a perspective view of a spindle of the zipper lock.

The present invention provides an integrated zipper lock to be mounted on a suitcase or the like for securing a pair of zipper pulls of the suitcase. As seen in FIGS. 1A-22D, the integrated zipper lock 10 is operable in a locked mode and in an open or unlocked mode. The lock 10 has a latch 110 movable between a first latch position and a second latch position. The lock 10 is operated in the locked mode when the latch 110 is in the first latch position, and in the open mode when the latch 110 is in the second latch position. The lock 10 has one or more locking members configured to engage with one or more zipper pulls to secure a zipper case, wherein each locking member is positionable between a closed position and an open position. According to an embodiment of the present invention, the lock 10 has a first locking member 140 and a second locking member 150 to separately engage with a first zipper pull 266 and a second zipper pull 268 in the locking-latch opening 25. The first and second members 140 and 150 are operatively coupled to a control plate 120 which is movable between a first control position and a second control position in a direction substantially perpendicular to the movement direction of latch 110, wherein when the control plate 120 is positioned in the first control position, the first and second locking members 140, 150 are prevented from moving to the open position.

The lock 10 has a lock body 20 having a first lock side 15 and a second lock side 17, and a base plate 170 fastened to the lock body 20 for accommodating the lock components of the lock 10. The lock 10 also has two blocking plates 130, each associated with one of the first and second locking members 140, 150. Each of the blocking plates 130 is movable between a first plate position and a second plate position. When the first and second locking members 140, 150 are moved from the closed position to the open position, the blocking plates 130 are caused to move from the first plate position to the second plate position to prevent the first and second locking members 140, 150 from moving back to the closed position.

Each of the blocking plates 130 has a spring support 132 and a blocking wall 131 positioned in relationship to the associated locking member 140, 150. The spring support 132 is arranged to support a spring 200 between the blocking plate 130 and the base plate 170.

The locking member 140/150 has a locking head 141/151, a locking slot 142/152, a head-support plate 144/154 for disposing the locking head 141/151 and a side plate 145/155 for providing the locking slot 142/152. The side plate 145/155 has a plate edge 143/153 arranged to contact with the blocking wall 131 of the associated blocking plate 130. Each of the locking members 140 and 150 is urged by a spring 190 to move toward the first lock side 15.

The lock 10 has a cam 60 movable between a first cam position and a second cam position. The cam 60 has a cam finger 61 positioned in relationship to the latch 110. The latch 110 is operatively coupled to both the combination mechanism and the key-overriding mechanism.

The combination mechanism includes the plurality of clutches 80 forming a stack of clutches, and the plurality of dials 180 for forming a combination code, each dial 180 associated with a clutch 80. The dials 180 together with the clutches 80 are placed at a dial placement section 22 and covered by a combination-mechanism cover 160. The combination mechanism further has a spindle 70 positioned in relationship to the clutches 80. The spindle 70 can be caused to move between a first spindle position and a second spindle position in a direction substantially parallel to the movement direction of the latch 110 when the dials 180 are turned to form the correct combination code. When the spindle 70 is positioned in the second spindle position, the cam 60 can be caused to move from the first cam position to the second cam position to push the latch 110 toward the second lock side 17 from the first latch position to the second latch position.

The key overriding mechanism has a cylinder 40 which can be rotated by a correct key 260. The cylinder 40 is coupled to the cam for rotational movement to move the cam finger 61 between a first finger position to a second finger position, wherein when the cam 60 is in the first cam position, the cam finger 61 can be caused to move from the first finger position to the second finger position so as to move the latch 110 from the first latch position to the second latch position, independently of the spindle position.

As seen in FIGS. 1A-7, the lock body 20 further has a button placement guide track 21 near the first lock side 15, a reset opening 23, and two locking-latch openings 25 near the second lock side 17. The base plate 170 has two spring supports 171 to support two springs 200. The lock 10 has a button unit which includes a button 30 coupled to the cam 60 and the cylinder 40. The button unit is controlled by the combination mechanism and the key-overriding mechanism. The button 30 is movable within the button placement guide track 21. The button 30 has an inner diameter dimensioned to receive a cylinder housing 50 with a housing edge 51. The button 30 has a cylinder housing slot 31 for placing the housing edge 51 so as to prevent the cylinder housing 50 from rotation relative to the button 30.

The cylinder housing 50 has an inner diameter dimensioned to receive the cylinder 40 and configured to allow the cylinder 40 to rotate relative to the cylinder housing 50 when a correct key in inserted into the cylinder 40. The cylinder 40 has a cylinder tip 41, and the cam 60 has a cam hole 62. The cam hole 62 is dimensioned to receive the cylinder tip 41 such that when the cylinder 40 is rotated, the cam finger 61 is caused to rotate from the first finger position to the second finger position.

Figure 9:
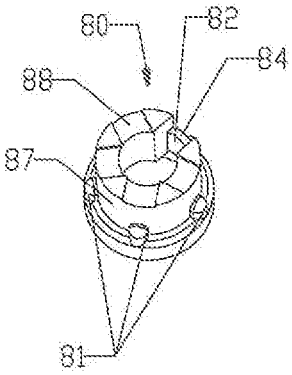
FIG. 9 is a perspective view of a clutch, according to an embodiment of the present invention.
Figure 10:
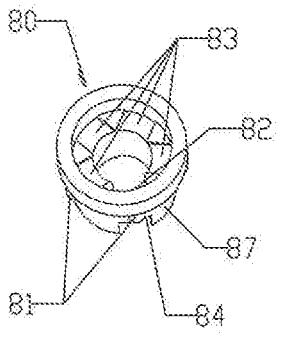
FIG. 10 is another perspective view of the clutch.
Figure 11:
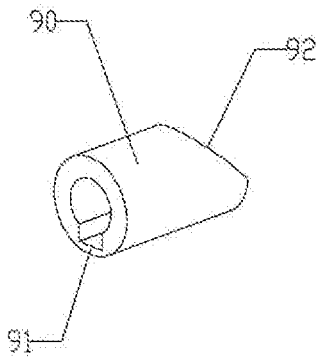
FIG. 11 is a perspective view of an end-cap.
Figure 19:
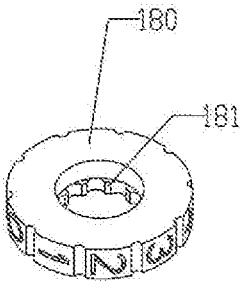
FIG. 19 is a perspective view of a dial.
Figure 20A:
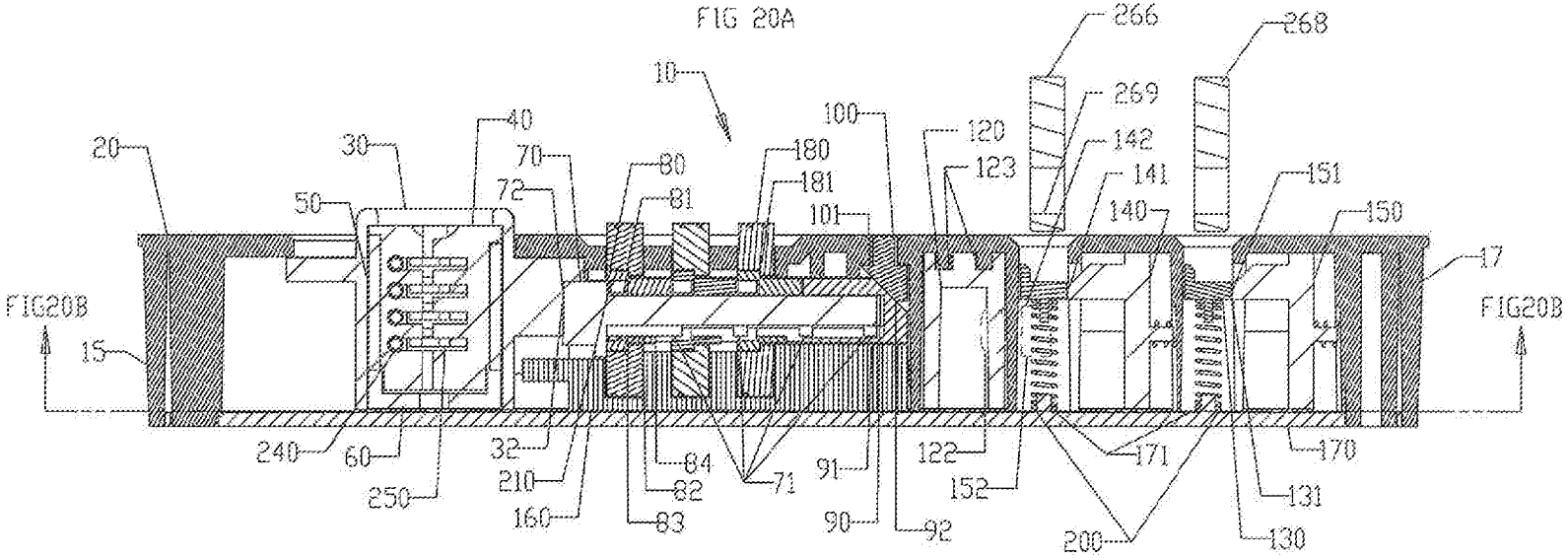
FIG. 20A is a side cross-sectional view of the zipper lock showing the lock in an open mode unlocked by the combination mechanism.
Figure 20B:
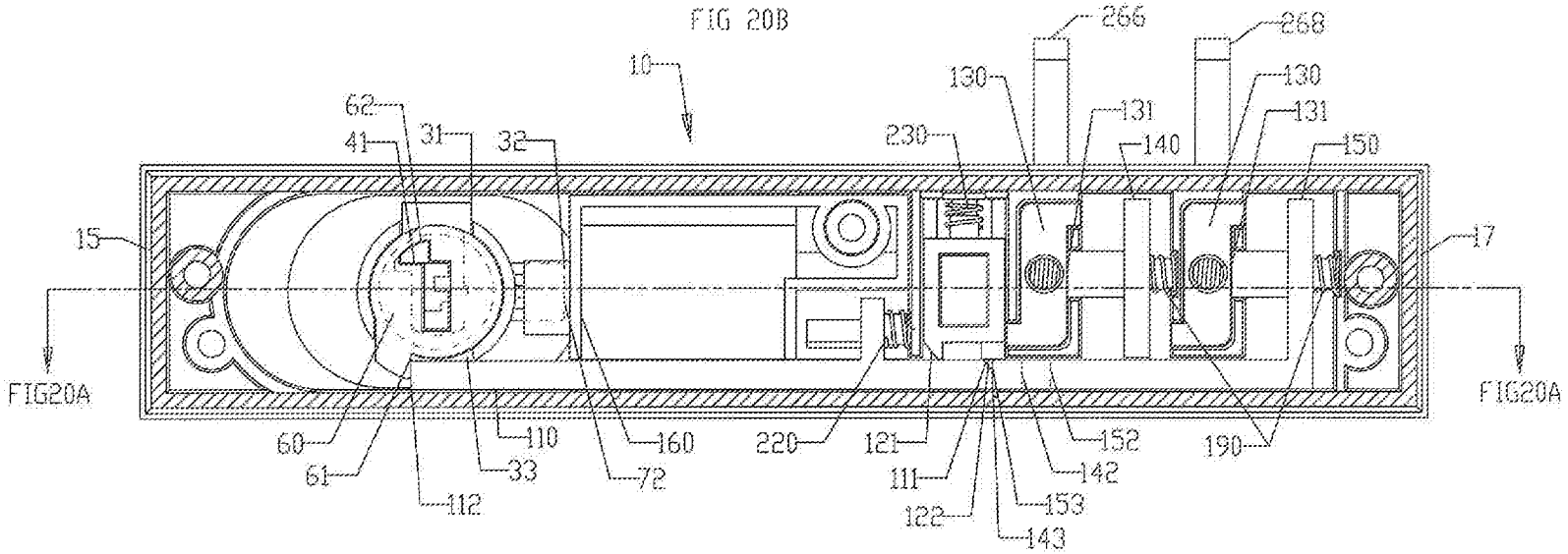
FIG. 20B is a bottom cross-sectional view of the zipper lock of FIG. 20A.
Figure 20C:
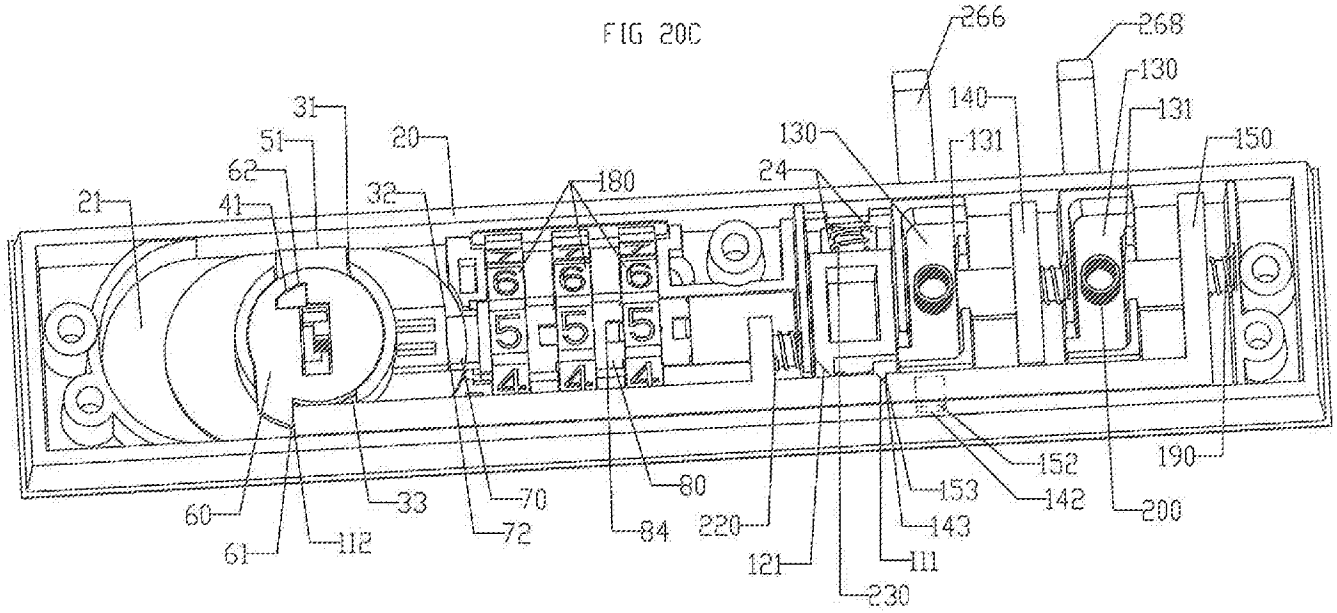
FIG. 20C is a perspective view showing the bottom of the zipper lock of FIG. 20A.
Figure 20D:
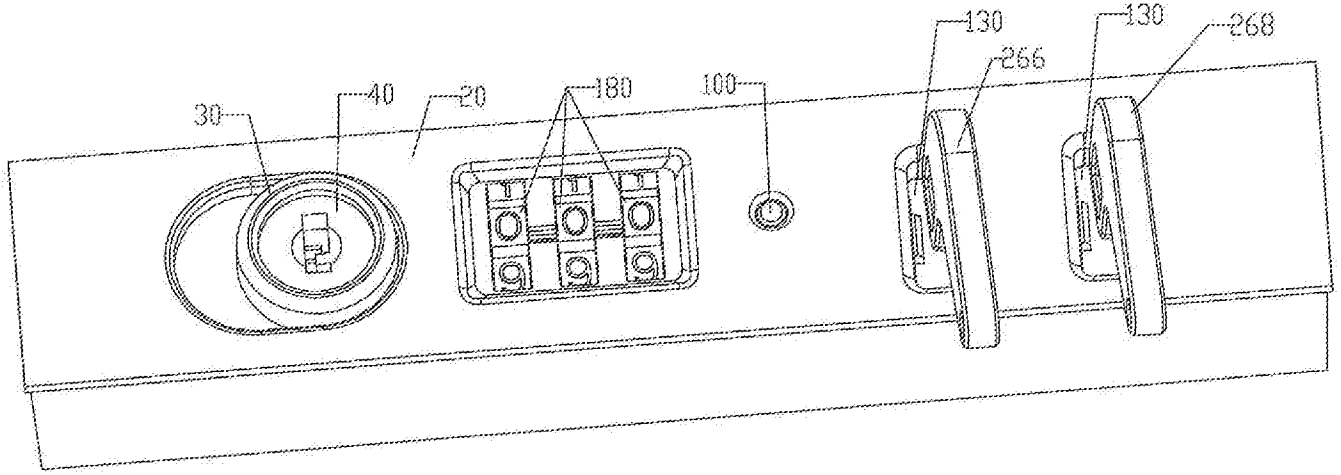
FIG. 20D is a perspective view showing the top part of the zipper lock of FIG. 20A.
Figure 21C:
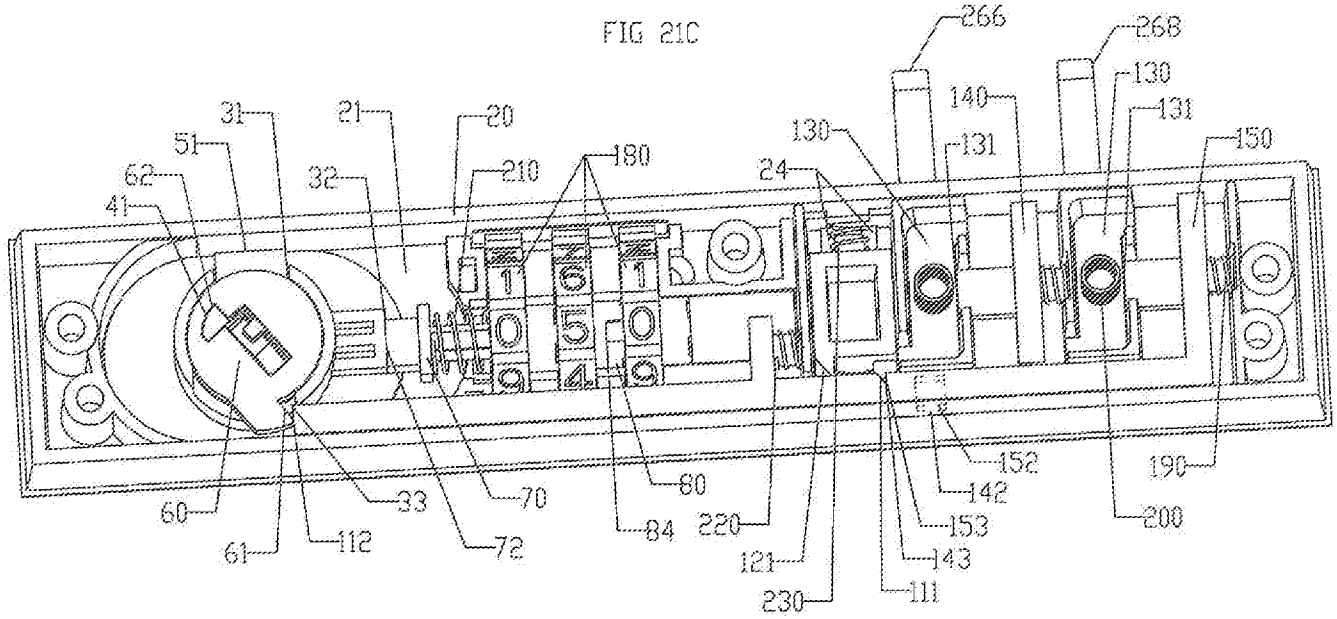
FIG. 21C is a perspective view showing the bottom of the zipper lock with the base plate removed.
Figure 21D:
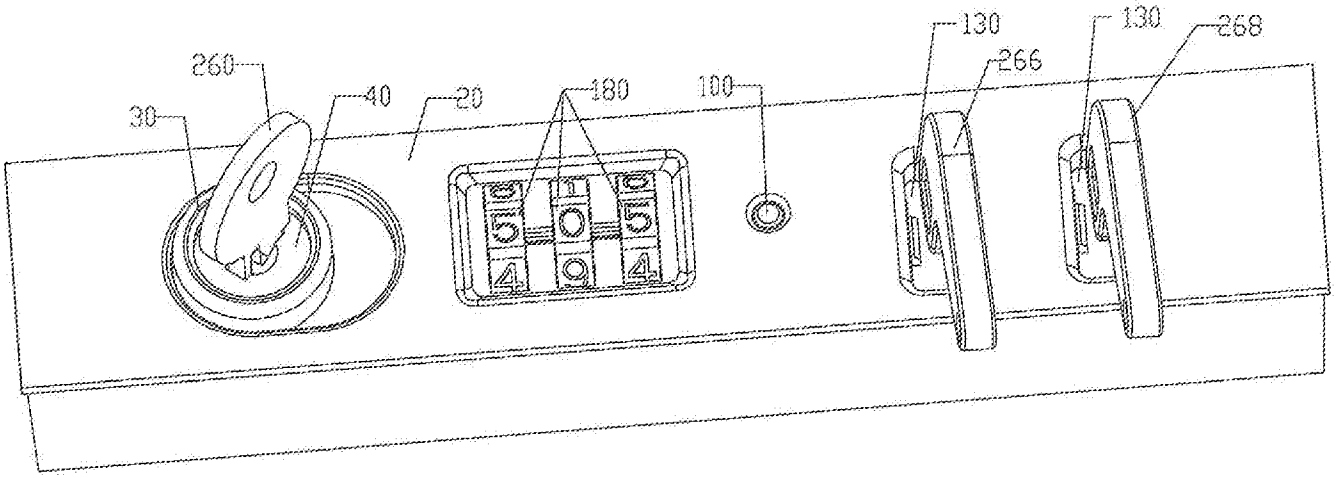
FIG. 21D is a perspective view showing the top part of the zipper lock of FIG. 21A.
Figure 22C:
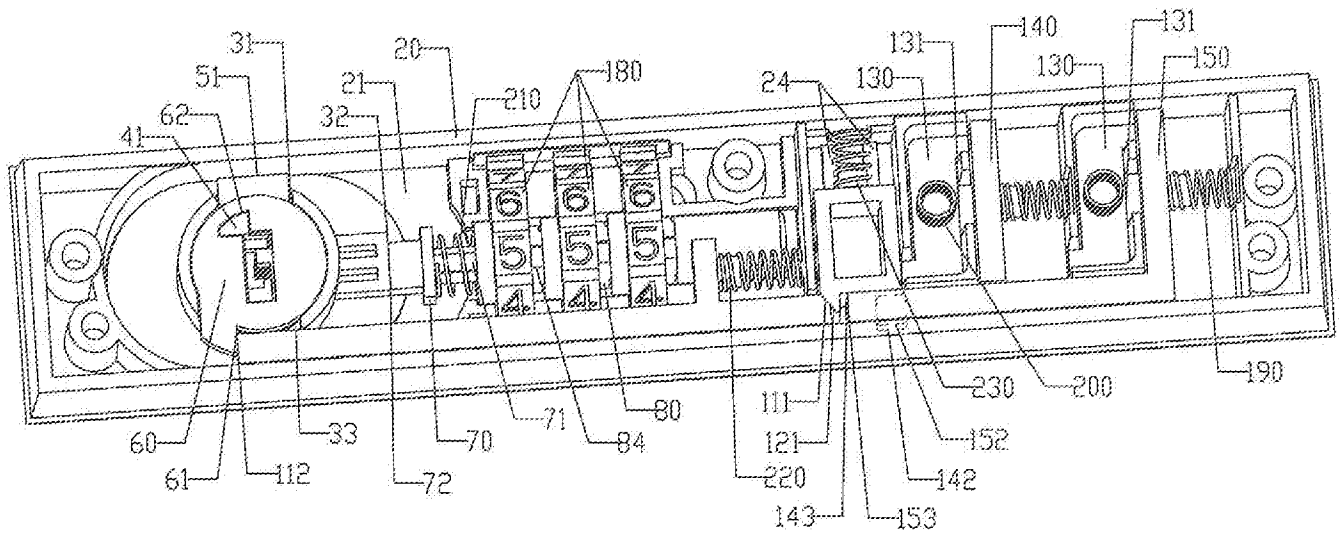
FIG. 22C is a perspective view showing the bottom of the zipper lock of FIG. 22A with the base plate and the combination mechanism cover removed.
Figure 22D:
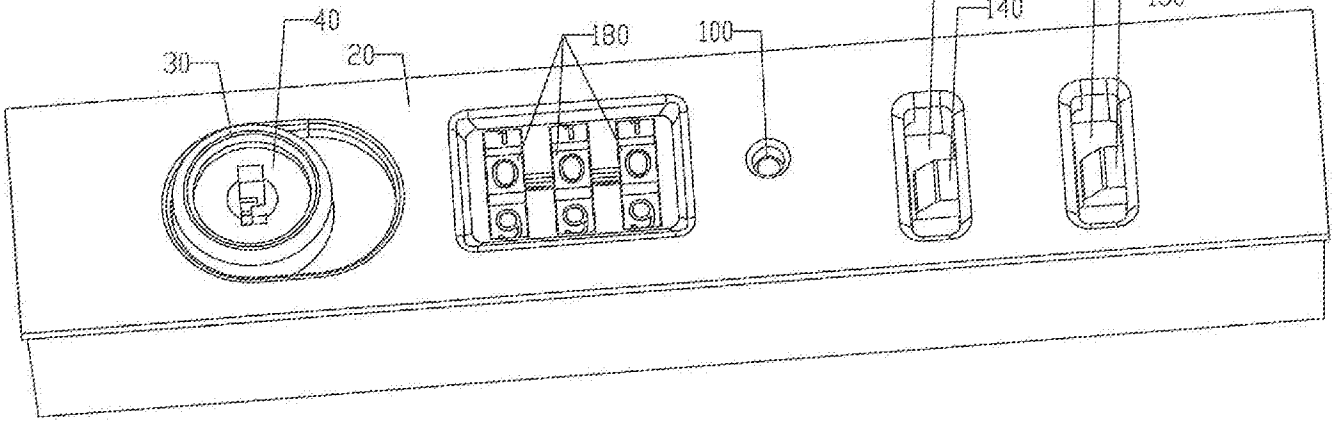
FIG. 22D is a perspective view showing the top of the zipper lock of FIG. 22A.
Figure 23C:
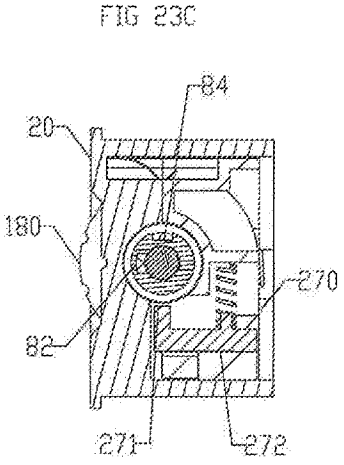
FIG. 23C is a cross-sectional view of the zipper lock showing the relationship between the decode fork and one of the clutches.
Figure 23A:
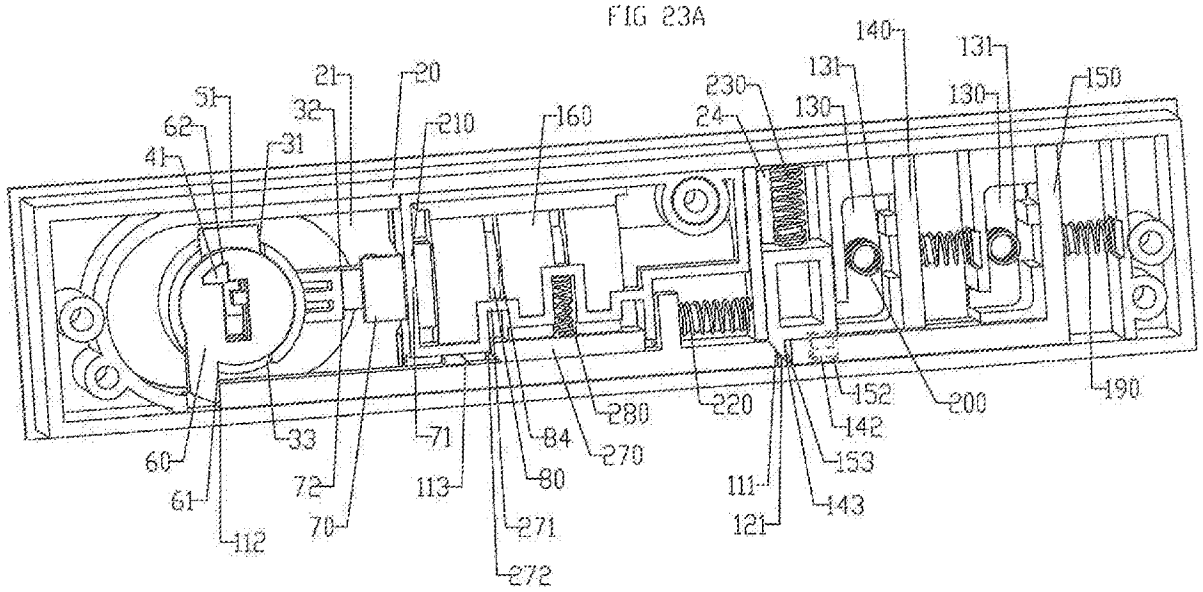
FIG. 23A is a bottom view of the zipper lock showing part of the lost code recovery mechanism.
Figure 23B:
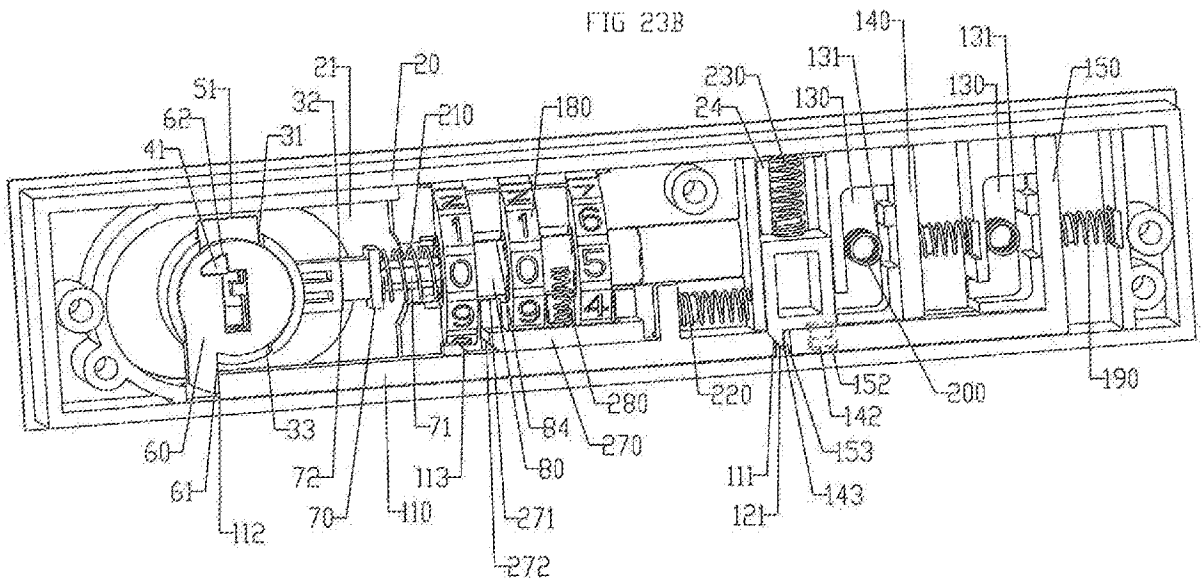
FIG. 23B is a bottom view of the zipper lock of FIG. 23A with the combination mechanism cover removed.
Figure 24C:
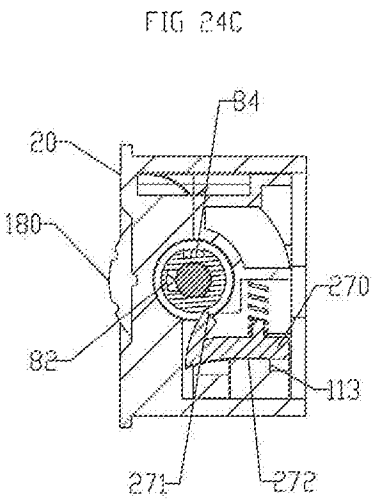
FIG. 24C is a cross-sectional view of the zipper lock showing the engagement between the decode fork and one of the clutches.
Figure 24B:
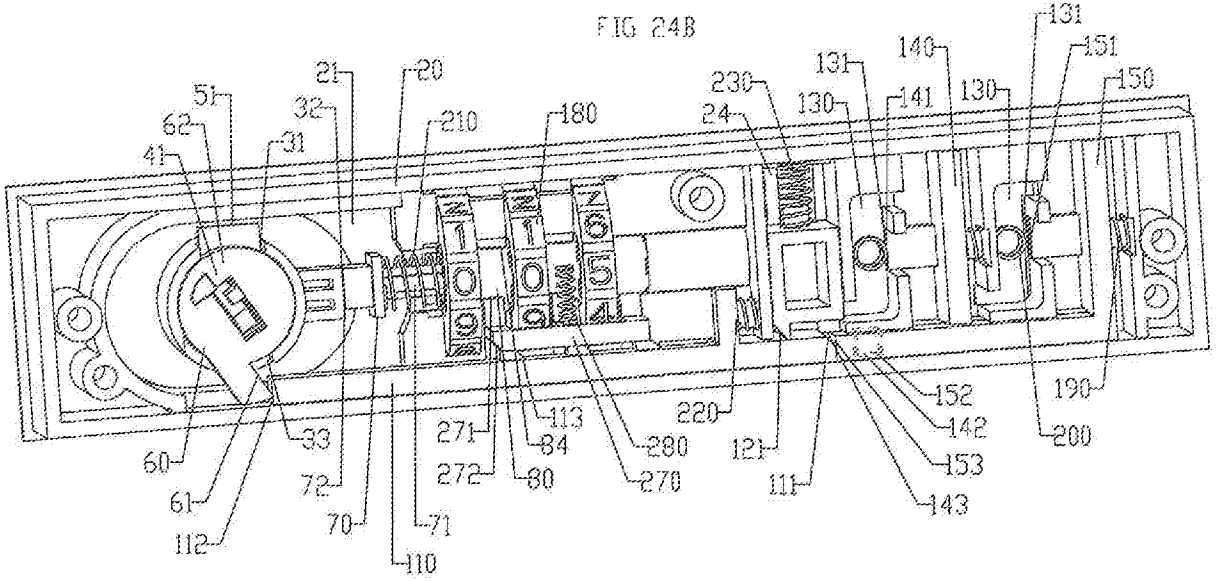
FIG. 24B is a bottom view of the zipper lock of FIG. 24A with the combination mechanism cover removed.
Figure 24A:
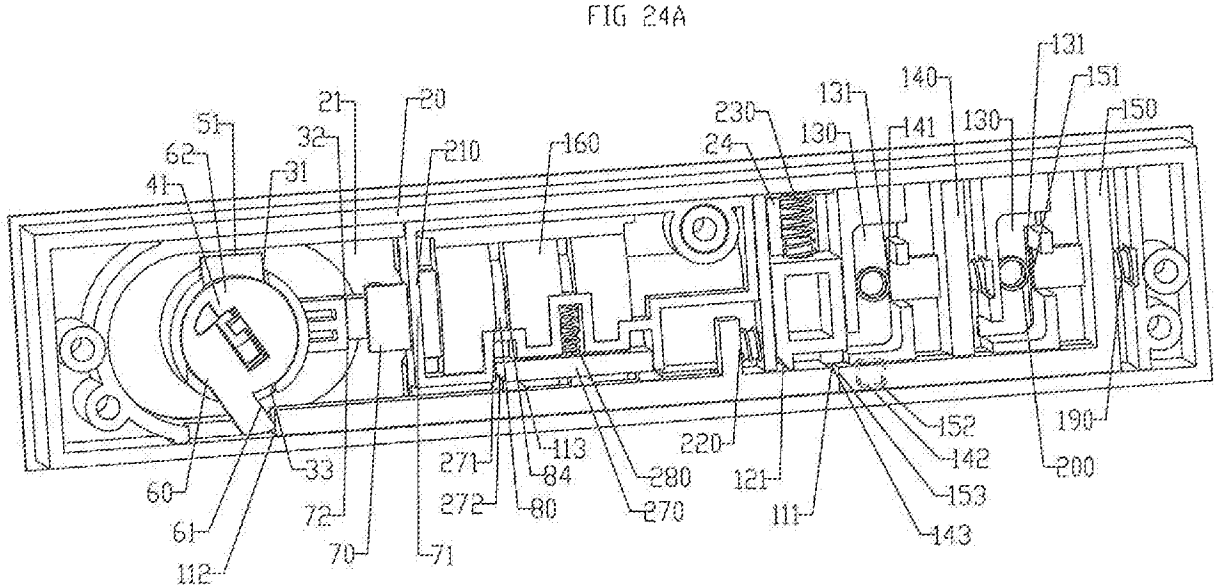
FIG. 24A is a bottom view of the zipper lock showing part of the lost code recovery mechanism in engagement with the clutches.
Figure 25A:
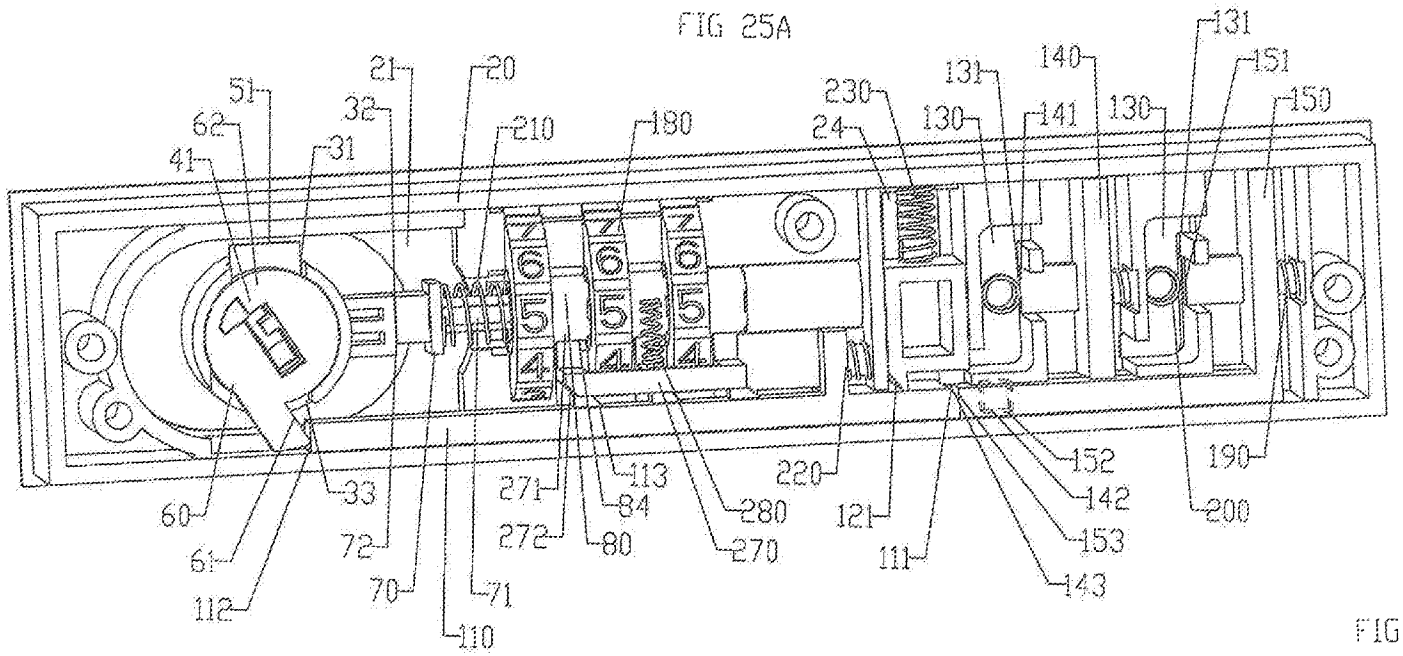
FIG. 25A is a bottom view of the zipper lock similar to FIG. 24B with some of the dials having been turned for causing the finger tips of the decode fork to fall into the decode slots on the clutches.
Figure 25B:
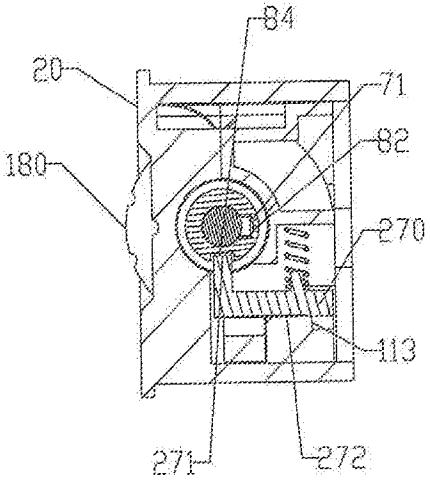
FIG. 25B is a cross-sectional view of the zipper lock showing the engagement of a finger tip and a decode slot.
Figure 27:
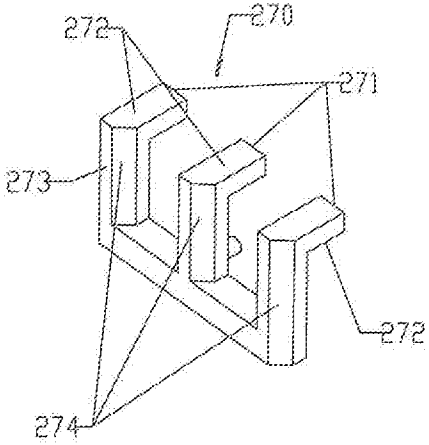
FIG. 27 is a perspective view of a decode fork for use in the lost code recovery mechanism.
Figure 29:
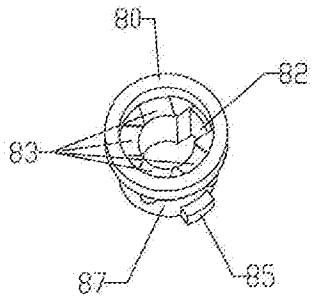
FIG. 29 is a perspective view that shows another view of the clutch of FIG. 28.
Figure 26:
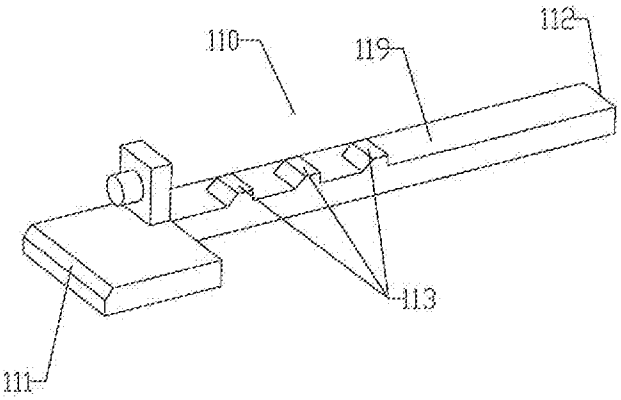
FIG. 26 is a perspective view of the latch, according to another embodiment of the present invention.
Figure 28:
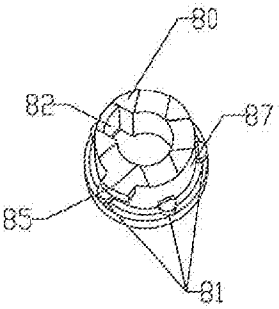
FIG. 28 is a perspective view that shows one view of the clutch, according to another embodiment of the present invention.

As seen in FIG. 1A, the spindle 70 has a spindle shaft 74 with a plurality of extended protrusions 71 provided thereon. One end of the spindle shaft 74 is attached to a rectangular block 72 disposed adjacent to the extended wall 32 of button 30. The other end of the spindle shaft 74 is positioned in relationship to an end cap 90. One end of the end cap 90 has an end cap slope 92. The other end of the end cap 90 has a channel dimensioned to receive the spindle shaft 74 and a protrusion slot 91 formed on the channel and dimensioned to receive the extended protrusions 71 on the spindle shaft 74 when the spindle 70 is caused to move from the first spindle position to the second spindle position (see FIG. 20A). With the engagement of protrusion slot 91 and at least one of the extended protrusions 71, the end cap 90 has no rotational motion relative to the spindle 70. As seen in FIGS. 9 and 10, each of the clutches 80 has a cylindrical body 87 having a through channel 88 dimensioned to receive the spindle shaft 74. The cylindrical body 87 has an opening slot 82 dimensioned to allow the associated extended protrusion 71 to pass through. The clutch 80 has a plurality of false gates 83 and a plurality of extended fins 81 extending from the outer surface of the cylindrical body 87. As seen in FIG. 19, each of the dials 180 has a plurality of teeth 181 dimensioned to receive the extended fins 81 of the associated clutch 81 for rotation together. When the lock 10 is in the locked mode, the extended protrusions 71 of spindle 70 are disengaged from the clutches 80, allowing the clutches 80 to rotate relative to the lock body 20.

Figure 12:
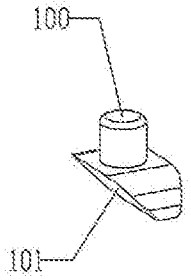
FIG. 12 is a perspective view of a reset button.
Figure 13:
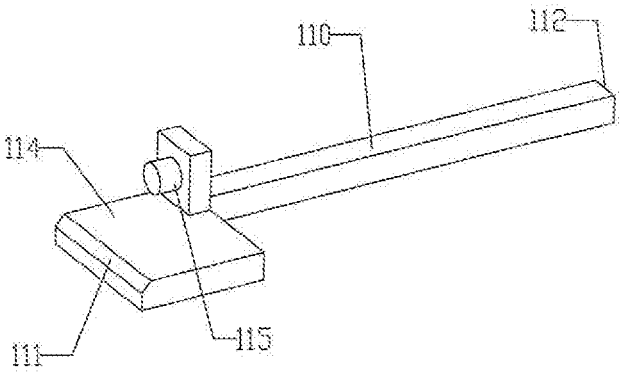
FIG. 13 is a perspective view of a latch.
Figure 14:
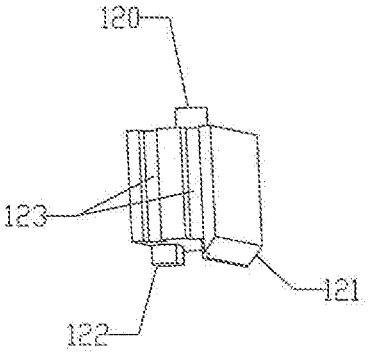
FIG. 14 is a perspective view of a control plate.
Figure 15:
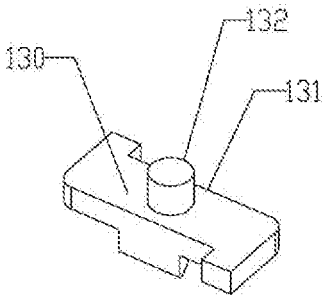
FIG. 15 is a perspective view of a blocking plate.
Figure 16:
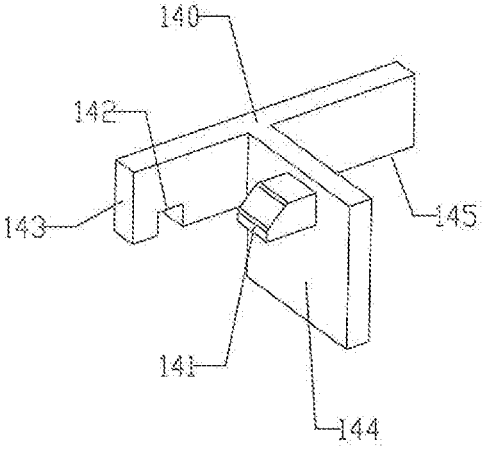
FIG. 16 is a perspective view of one locking member.
Figure 17:
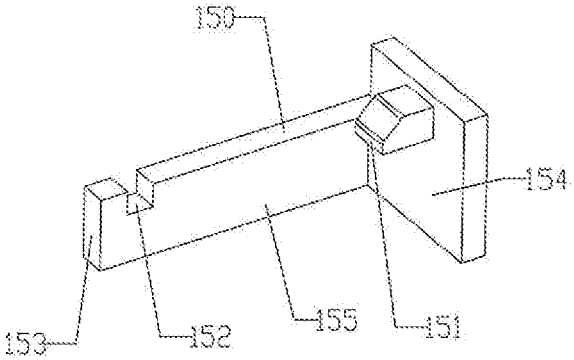
FIG. 17 is a perspective view of another locking member.
Figure 18:
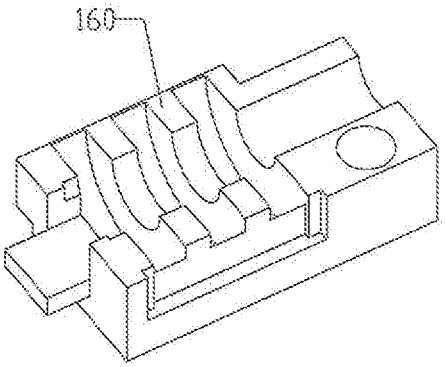
FIG. 18 is a perspective view of a combination-mechanism cover.

To open the lock 10 by the combination mechanism, the dials 180 must be rotated to form a correct combination code such that all of the opening slots 82 of clutches 80 are aligned with the extended protrusions 71 of spindle 70. As such, the spindle 70 can be pushed by the button 30 toward the second lock side 17 of lock body 20. When the dials 180, together with the clutches 80, are rotated relative to the spindle 70, the false gates 83 of each of the clutches 80 are also rotated relative to the associated extended protrusion 71 of spindle 70. Contact between the false gates 83 and the extended protrusion 71 generates a clicking sound as an anti-pick measure. As seen in FIG. 12, the combination mechanism has a reset button 100 with a reset slope 101 disposed in relationship with the cap slope 92 of end cap 90. The top of the reset button 100 is exposed to the upper side of the lock body 20 through the reset opening 23 on the lock body 20. As seen in FIG. 13, the latch 110 has a latch base 114 with a slope wall 111, a spring support 115 and a latch edge 112. The latch edge 112 is placed against the cam finger 61 of cam 60, allowing the cam finger 61 to push the latch 110 toward the second lock side 17 from the first latch position to the second latch position. The slope wall 111 is placed in relationship to the control plate 120 which is movable between a first control position and a second control position in a direction substantially perpendicular to the movement direction of the latch 110, such that when the latch 110 is moved from the first latch position to the second latch position, the control plate 120 is caused to move from the first control position to the second control position and the first and second locking members 140 and 150 are caused to move from the closed position to the open position. The control plate 120 has two track slots 123, a control member 122 and a control edge 121. The control edge 121 is placed against the slope wall 111 of latch 110. The track slots 123 are arranged to engage with two tracks 24 of lock body 20 for linear movement.

Locked Mode (FIGS. 1A-19)

According to an embodiment of the present invention, the button unit is controlled by both the combination mechanism and the key-overriding mechanism. The button 30 in the button unit includes the cylinder 40 which is coupled to the cylinder housing 50. The cylinder 50 has a plurality of wafers 250 extended into the cylinder housing 50 by the urging forces of the springs 240. The housing edge 51 of cylinder housing 50 is engaged in the cylinder-housing slot 31 of button 30, preventing the cylinder housing 50 from rotation relative to the button 30. The button 30 also has a cam slot 33 for placing the cam finger 61 of cam 60, allowing the cam finger 61 to move within the cam slot 33 when the cam 60 is rotated relative to the button 30. As the cylinder tip 41 of cylinder 40 is engaged in the cam hole 62 of cam 60, and the wafers 250 of cylinder 40 are extended into the cylinder housing 50, the cam 60 is prevented from rotation relative to the button 30. The cam finger 51 is prevented from rotational movement relative to the button 30 without using a correct key to turn the cylinder 40.

When the lock 10 is in the locked mode, the spindle 70 is prevented from moving relative to the lock body 20 because of the misalignment between one or more extended protrusions 71 and the associated clutches 80. As the extended wall 32 of button 30 is in contact with the spindle head 72 of spindle 70, the button 30, along with the cylinder housing 50, the cylinder 40 and the cam 60, is also prevented from moving relative to the lock body 20. Thus, the latch 110 cannot be pushed toward the second lock side 17 from the first latch position to the second latch position to unlock the lock 10.

When the lock 10 is in the locked mode, the latch 10 is positioned in the first latch position such that the control plate 120 is pushed toward the latch 110 by spring 230 so that the control edge 121 of control plate 120 is in contact with the slope wall 111 of latch 110, and the control member 122 of control plate 120 is lodged in the locking slots 142/152 of locking members 140/150.

Unlocked by Combination Mechanism (FIGS. 20A-20D)

After the dials 180 are turned to match a predetermined combination code, each of the opening slots 82 of clutches 80 is aligned with each of the extended protrusion 71 of spindle 70. The spindle 70 is movable relative to the locking body 20 from the first spindle position to the second spindle position as the end of the spindle shaft 74 is received into end cap 90. As such, the button 30 can be pushed toward the second lock side 17 of lock body 20. Through the contact between the extended wall 32 of button 30 and the spindle head 72, the spindle 70 can move relative to the locking body 20 from the first spindle position to the second spindle position to open the lock 10. As the latch 110 moves toward the second lock side 17, through the contact between the slope wall 111 of the latch 110 and the control edge 121 of control plate 120, the control plate 120 is caused to move inward to an inner position, away from the latch in a direction substantially perpendicular to the movement direction of the latch 110. As such, the control member 122 of control plate 120 is disengaged from both the locking slot 142 of the first locking member 140 and the locking slot 152 of the second locking member 150. As the latch 110 moves toward the second lock side 17, through the contact between the latch edge 112 of latch 110 and both the plate edge 143 and the plate edge 153, the first and second locking members 140, 150 are pushed toward the second lock side 17, from a locking position to a releasing position. Thus, the locking heads 141, 151 of locking members 140, 150 are pushed away from the locking-latch openings 25 and disengaged from the zipper pull opening 269 of zipper pulls 266, 168. At the same time, under the urging force of spring 200, each of the blocking plates 130 is moved upward to an upper position, further away from the base plate 170, to release the zipper pulls 266, 268 from the lock 10. When the blocking plates 130 are in the upper position, the blocking walls 131 of blocking plates 130 are arranged to prevent the locking heads 141, 151 from returning to the locking-latch openings 25.

When the user releases the button 30, a latch spring 220 on the spring support 115 urges the latch 110 and the button 30 to move toward the first lock side 15. At the same time, a spindle spring 210 urges the spindle 70 to move from the second spindle position to the first spindle position. However, the control plate 120 remains at the inner position because of the misalignment between the control member 122 of control plate 120 and the locking slots 142, 152 of locking members 140, 150. The blocking plates 130 are also in the upper position to prevent the locking heads 141, 151 from returning to the locking-latch openings 25.

It should be noted that the cam 60 can only be rotated along with the cylinder 40 which can only be turned with a correct key for unlocking the lock. In the locking and unlocking of the lock using the combination mechanism, the cam 60 can only have a linear movement along with the button 30.

Reset Combination (FIGS. 22A-22D)

When the lock 10 is unlocked by the combination mechanism, the opening slot 82 of each of the clutches 80 is aligned with the associated extended protrusion 71 of spindle 70 and spindle 70 is movable between the first spindle position and the second spindle position. When the button 30 is released, the spindle 70 is urged to move to the first spindle position by the spindle spring 210, while each of the dials 80 remains engaged with the associated clutch 80. When the spindle 70 is in the first spindle position, the end cap 90 can move toward the dials 180.

To reset the combination, the user must push the reset button 100 downward. Through the contact between the reset slope 101 and the cap slope 92 of end cap 90, the downward movement of the reset button 100 causes the end cap 90 to push the stack of clutches 80 toward the button 30, thereby disengaging the extended fin 81 of each of the clutches 80 from the teeth 181 of the associated dial 180. However, each of the protrusions 71 of spindle 70 remains located within the opening slot 82 of the associated clutch 80, preventing the clutches 80 from rotation relative to spindle 70. The disengagement of the dials 180 from the clutches 80 allows the user to turn the dials 180 independently of the clutches 80 to a desired new combination. After resetting, the user releases the reset button 100 to allow the spindle spring 210 to push the extended fin 81 of clutches 80 back into the engaging position with the teeth 181 of dials 80.

Unlocked by Key-Overriding Mechanism (FIGS. 21A-21D)

As seen in FIGS. 4-7, the cylinder tip 41 of cylinder 40 is lodged in the cam hole 62 of cam 60, and the cam finger 61 of cam 60 is placed in the cam slot 33 of button 30 for rotation relative to the button 30. The housing edge 51 of cylinder housing 50 is lodged in the cylinder housing slot 31 of button 30 to prevent the cylinder housing 50 from rotation relative to the button 30. Thus, the rotational movement of the cylinder 40 along with the cam 60 is controlled by the wafers 250 in the cylinder 40. When the lock 10 is in the locked mode, the wafers 250 are extended into the wafer slots 53 of cylinder housing 50 by the springs 240, preventing the cylinder 40 and the cam 60 from rotating relative to the cylinder housing 50. When a correct key 260 is inserted into the cylinder 40, the key 260 causes the wafers 250 to retract from the cylinder housing 50, allowing the user to turn the cylinder 40 along with the cam 60 relative to the cylinder housing 50. The cam finger 61 of cam 60 is rotated accordingly within the cam slot 33 of button 30 toward the second lock side 17. Through the contact between the cam finger 61 of cam 60 and the latch edge 112 of latch 110, the latch 100 is also caused to move toward the second lock side 17 from the first latch position to the second latch position. As the latch 110 moves toward the second lock side 17 to the second latch position, through the contact between the slope wall 111 of latch 110 and the control edge 121 of control plate 120, the control plate 120 is caused to move inward to the inner position, away from the latch 110, in a direction substantially perpendicular to the movement direction of the latch 110. As such, the control member 122 of control plate 120 is disengaged from both the locking slot 142 of the first locking member 140 and the locking slot 152 of the second locking member 150. At the same time, through the contact between the latch edge 112 of the latch 110 and both the plate edge 143 and the plate edge 153, the first and second locking members 140, 150 are pushed toward the second lock side 17. Thus, the locking heads 141, 151 of locking members 140, 150 are pushed away from the locking-latch openings 25. At the same time, under the urging force of spring 200, each of the blocking plates 130 is moved upward to an upper position, further away from the base plate 170, to disengage the zipper pulls 266, 268 from the lock 10.

Lost Code Recovery Mechanism (FIGS. 23A-29)

According to an embodiment of the present invention, the lock 10 also has a lost-code recovery mechanism to help a user to determine the combination code, if needed. The lost-code recovery mechanism has a decode fork 270 positioned in relationship to the latch 110. The latch 110 further has a plurality of sloped bumps 113 located on a latch surface 119, each sloped bump 113 associated with a clutch 80. The decode fork 270 has a plurality of decode fingers 272. Each of the decode fingers 272 has a finger base surface 273 and a finger sloped surface 274 positioned adjacent to a sloped bump 113. Each of the decoder fingers 272 has a finger tip 271 made of an elastic material such as rubber to allow the finger tip 271 to bend. Each of the clutches 80 has a decode slot 84 formed on the outer surface of cylindrical body 87, in relationship to the opening slot 82. The decode slot 84 is dimensioned to receive the finger tip 275. When the lock 10 is in the locked mode, the finger tips 271 are located adjacent to but spaced from clutched 80 so as not to interfere with the rotation of clutch 80.

When the lock 10 is unlocked by the key 260, the latch 110 is caused to move toward the second lock side 17. Through the contact between each of the sloped bumps 113 and the finger sloped surface 274 of each of the decoder fingers 272, the finger base surfaces 273 are pushed by the sloped bumps 113 away from the latch surface 119, and the finger tips 271 are caused to press against the outer surface of cylindrical body 87 of clutches 80. To recover the lost code, the user can unlock the lock 10 with a correct key 260. While keeping the cylinder 40 and the cam 60 in the rotated position, the user can turn each of the dials 180 along with the associated clutch 80 until the associated finger tip 271 falls into the decode slot 84 of clutch 80. The engagement of the finger tip 275 and the decode slot 84 renders turning the associated dial 180 more difficult. When all the finger tips 271 are engaged with the decode slots 84 of clutches 80, the user can recover the lost combination code based on the relationship of the decode slot 84 and the opening slot 82 of clutch 80.

After the key 260 is withdrawn, the spring 220 urges the latch 110 to move back to the first latch position, causing the sloped bumps 113 to disengage from the finger base surfaces 273. The spring 280 also urges the decode fork 270 to move away from the clutches 80 so as to allow the clutches 80 to rotate without interference.

According to another embodiment of the present invention, instead of having a decode slot 84 formed on the cylindrical body 87, each of the clutches 80 has an extended finger 85 (FIG. 29) on the cylindrical body 87 to stop the finger tip 271 as the user turns each of the dials 180 along with the associated clutch while keeping the cylinder 40 and the cam 60 in the rotated position. The engagement of the finger tip 271 and the extended finger 85 of clutch 80 renders turning the dial 180 more difficult. The user can recover the lost combination code based on the relationship of the extended finger 85 and the opening slot 82 of clutch 80.

Figure 30C:
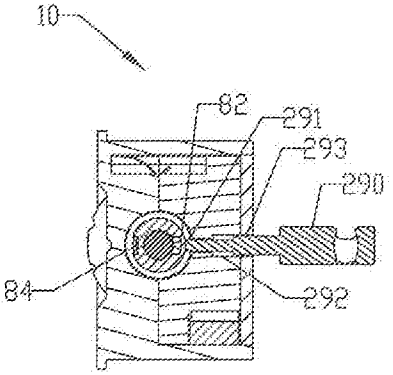
FIG. 30C is a cross-sectional view of the zipper lock showing the relationship between a picking tool and one of the clutches.
Figure 30B:
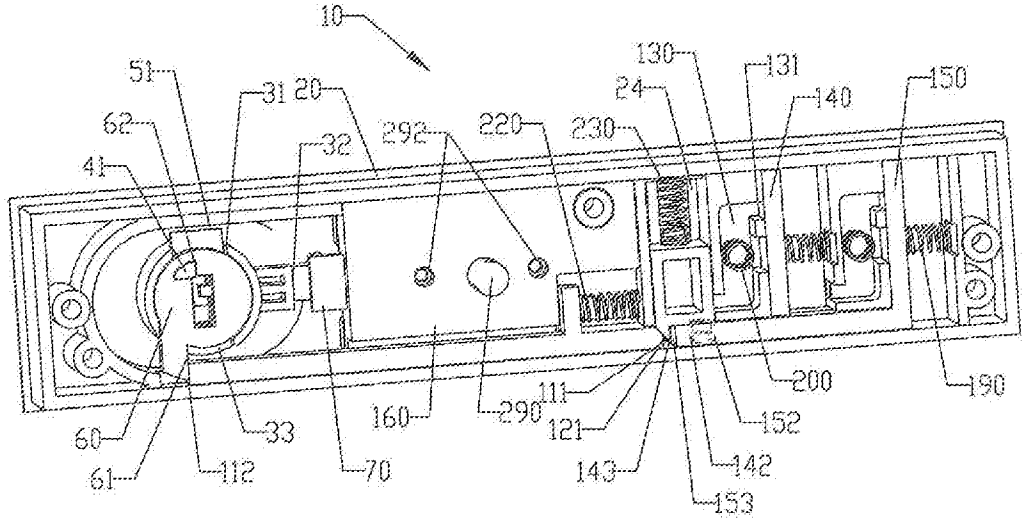
FIG. 30B is a bottom view of the zipper lock of FIG. 30A with the combination-mechanism cover.
Figure 30A:
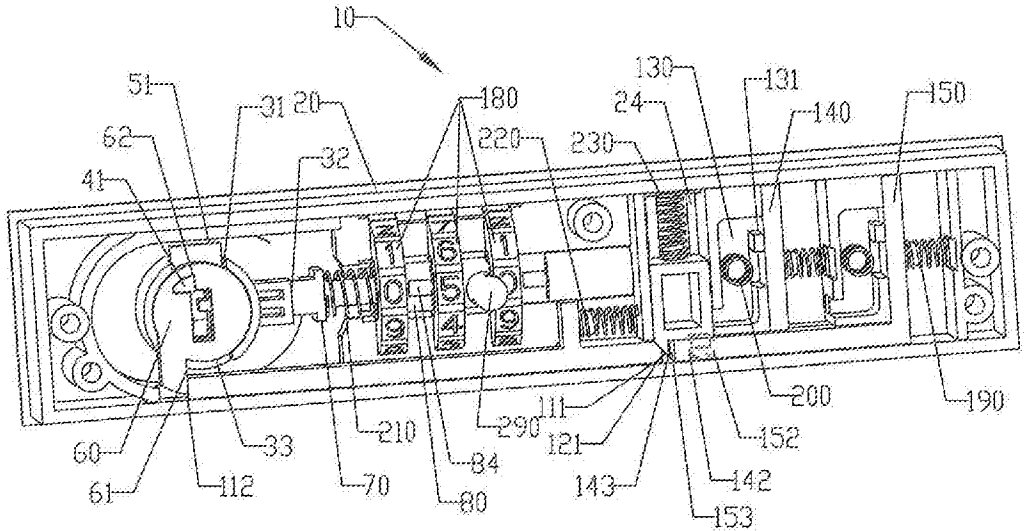
FIG. 30A is a bottom view of the zipper lock with the combination-mechanism cover removed to show another lost code recovery mechanism.
Figure 31A:
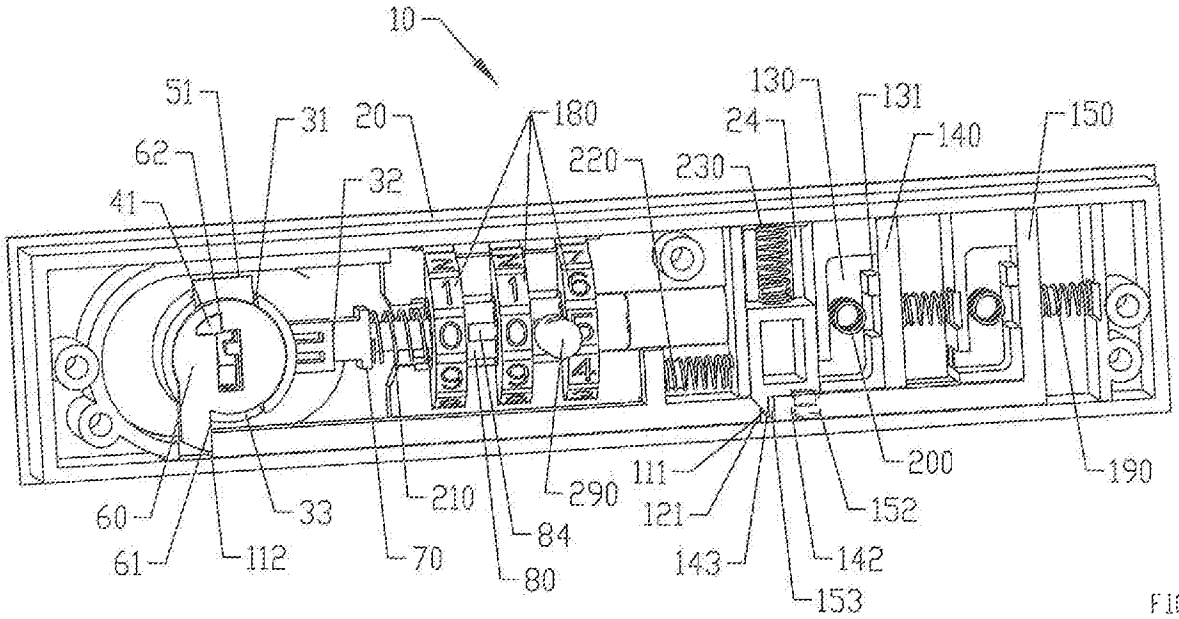
FIG. 31A is a bottom view of the zipper lock similar to 30A with some of the dials having been turned.
Figure 31B:
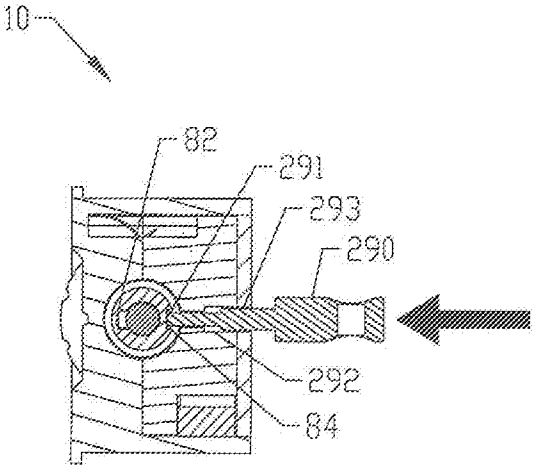
FIG. 31B is a cross-sectional view of the zipper lock showing the engagement of the picking tool and one of the clutches.
Figure 32:
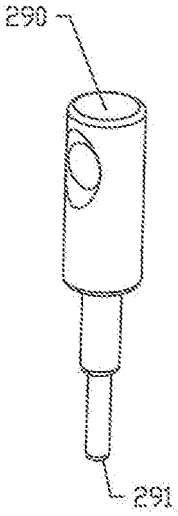
FIG. 32 is a perspective view of a picking tool for use in the lost code recovery mechanism as shown in FIGS. 30A and 30B.
Figure 34:
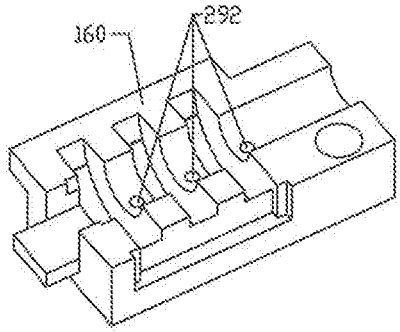
FIG. 34 is a perspective view of a combination-mechanism cover, according to an embodiment of the present invention.
Figure 35:
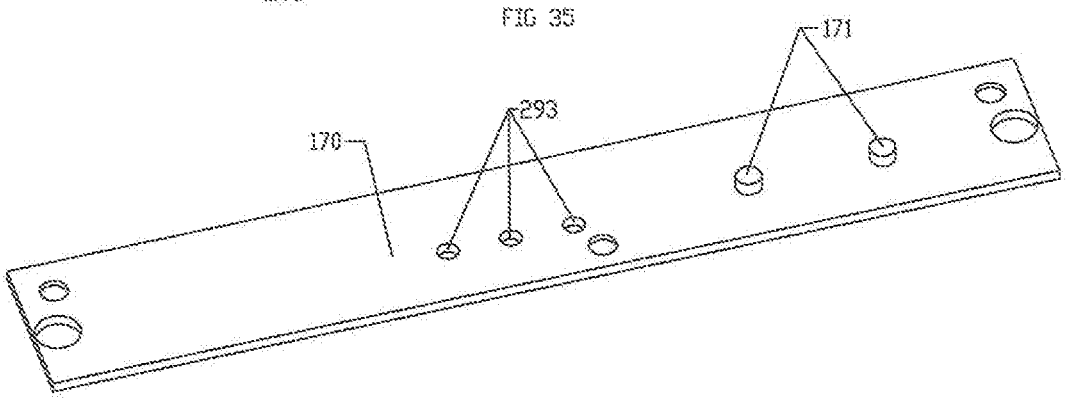
FIG. 35 is a perspective view of a base plate, according to an embodiment of the present invention.
Figure 33:
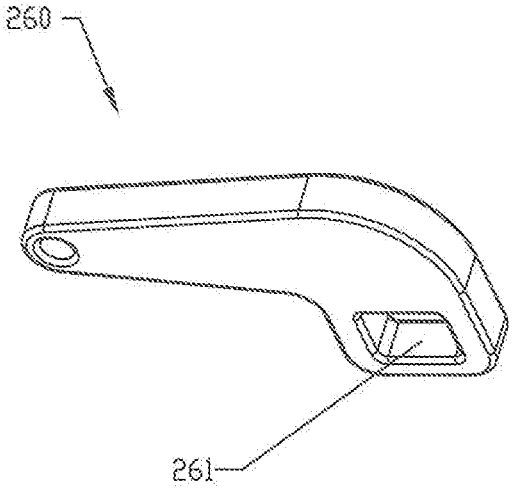
FIG 33 (PRIOR ART)
FIG. 33 is a perspective view of a typical zipper pull.

According to a different embodiment of the presentation, the lost code can be recovered using a picking tool 290, instead of the decode fork 270. Without the decode fork 270, the sloped bumps 113 (FIG. 26) are no longer needed. As shown in FIG. 32, the picking tool 290 has a pointer 291 designed to separately engage with the decode slot 84 of each of the clutches 80. The pointer 291 is dimensioned to be inserted through the picking holes 293 on base plate 170 and the picking holes 292 on combination-mechanism cover 160 as shown in FIGS. 34 and 35. In order to recover the lost code using the picking tool 290, the user uses the correct key 260 to release the zipper pulls 266, 268 to expose the base plate 170 of lock 10. The user can release the rotation of the cylinder 40 by the key 260 while turning the dials 180. As shown in FIGS. 30A and 30B, the lock 10 is in the locked mode when the arrangement of the dials 180 does not match the combination code and the dials 180 can be separately turned relative to the lock body 20. One of the clutches 80 is shown in FIG. 30C showing that the pointer 291 of picking tool 290 is pressing against the clutch 80. When the pointer 291 of picking tool 290 falls into the decode slot 84 of clutch 80 (FIG. 31B), the turning of the dial 180 becomes more difficult. In order to recover the lost code, the user is required to turn the dials 180 as indicated in FIG. 31A until the pointer 291 has found the decode slot 84 of each of the clutches 80. The user can then recover the lost combination code based on the relationship of the decode slot 84 and the opening slot 82 of clutch 80.

In summary, the zipper lock 10 of the present invention can be opened by the combination mechanism based on the arrangement of dials 180 and clutches 80 or by the key overriding mechanism using the key 260 to turn the cylinder 40. Both the combination mechanism and the key-overriding mechanism are arranged to move a latch 110 from a first latch position to a second latch position to disengage the locking members 140, 150 from the zipper pulls 266, 268. The lock 10 also has a lost code recovery mechanism to allow a user to recover the lost combination code, if needed. The lost code can be recovered with a decode fork 270 or by a picking tool 290.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A lock, comprising:

a latch movable between a first latch position and a second latch position;

a first locking mechanism operatively coupled to the latch;

a second locking mechanism operatively coupled to the latch;

at least one locking member operatively coupled to the first locking mechanism and the second locking mechanism, wherein the at least one locking member is positionable between a closed position and an open position and configured for positioning in the open position when the latch is in the second latch position, wherein the first locking mechanism and the second locking mechanism are each configured to independently cause the latch to move from the first latch position to the second latch position in a movement direction, and wherein the first locking mechanism comprises at least one clutch and at least one dial associated with said at least one clutch, and a spindle engaged with said at least one clutch, moveable between a first spindle position and a second spindle position in a direction substantially parallel to the movement direction of the latch, wherein when the spindle is positioned in the second spindle position, the latch is allowed to move to the second latch position, and a control plate operatively coupled to said at least one locking member, the control plate moveable between a first control position and a second control position in a direction substantially perpendicular to the movement direction of the latch, wherein when the control plate is positioned in the first control position, the at least one locking member is prevented from moving to the open position.

2. The lock according to claim 1, wherein the at least one locking member comprises a locking slot and the control plate comprises a locking member, and wherein when the control plate is positioned in the first control position, the locking member is engaged with the locking slot, and when the control plate is positioned in the second control position, the locking member is released from the locking slot.

3. The lock according to claim 1, wherein when the latch is caused to move from the first latch position to the second latch position, the control plate is caused to move from the first control position to the second control position and the at least one locking member is also caused to move from the closed position to the open position.

4. The lock according to claim 3, wherein the at least one locking member comprises a locking head configured to engage with a zipper pull, the locking head positioned in a locking position when the at least one locking member is in the closed position and in a releasing position when the at least one locking member is in the open position, said lock further comprising at least one blocking plate positioned in relationship to the locking head, the at least one blocking plate positionable between a first plate position and a second plate position, wherein when the locking head is moved from the locking position to the releasing position to release the zipper pull, the blocking plate is arranged to move from the first plate position to the second plate position to prevent the locking head from moving to the locking position.

5. The lock according to claim 4, wherein when the blocking plate is caused by the zipper pull to move from the second plate position to the first plate position, the locking head is arranged to move to the locking position to secure the zipper pull.

6. The lock according to claim 3, wherein the latch comprises a slope wall and the control member comprises a slope edge, and when the latch is caused to move toward the second latch position, the slope wall of the latch is arranged to apply a force on the slope edge of the control plate, causing the control plate to move from the first control position to the second control position.

7. The lock according to claim 6, wherein when the control plate is in the second control position, the latch can be caused to move to the second latch position, the at least one locking member is arranged to move from the closed position to the open position.

8. The lock according to claim 1, wherein said at least one clutch comprises a plurality of clutches forming a stack of clutches, and said at least one dial comprises a plurality of dials, each of the dials associated with a different one of the clutches, and the spindle comprises a spindle shaft and a spindle head connected to one end of the spindle shaft, the spindle shaft having a plurality of extended protrusions, each extended protrusion associated with one of the clutches, and wherein each of the clutches comprises an cylindrical body having a through channel dimensioned to receive the spindle shaft, the cylindrical body further comprising an opening slot formed into the through channel, the opening slot dimensioned to receive the associated extended protrusion, and when the opening slot of each of the clutches is aligned with the associated extended protrusion of the spindle shaft, the spindle is allowed to move from the first spindle position to the second spindle position.

9. The lock according to claim 8, wherein the cylindrical body of each of the clutches comprises an outer surface having one or more extended fins, and each of the dials comprises a dial inner opening dimensioned to receive the cylindrical body of the associated clutch, each of the dials further comprising a plurality of indents formed on the dial inner opening, the indents dimensioned to engage with said one or more extended fins of the associated clutch so as to allow each of the dials and the associated clutches to rotate together relative to the spindle.

10. The lock according to claim 8, further comprising a cam movable between a first cam position and a second cam position in a direction substantially parallel to the movement direction of the latch, the cam comprising a cam finger positioned in relationship to the latch, wherein when the spindle is positioned in the second spindle position, the cam can be caused to move from the first cam position to the second cam position and the cam finger is arranged to push the latch to the second latch position.

11. The lock according to claim 1, further comprising a cam having a cam finger positioned in relationship to the latch, wherein the second locking mechanism comprises a cylinder coupled to the cam for rotation together for moving the cam finger from a first finger position to a second finger position so as to move the latch from the first latch position to the second latch position independently of whether the spindle is positioned in the first spindle position or the second spindle position.

12. The lock according to claim 11, wherein the cylinder comprises a cylinder tip and the cam further comprises a cam hole dimensioned to receive the cylinder tip to prevent the cylinder from rotation relative to the cam, the cylinder further comprising a plurality of wafers, said lock further comprising a cylinder housing having a housing edge and a plurality of wafer slots, the wafer slots dimensioned to receive the wafers of the cylinder, and a button having a cylinder housing slot and a cam slot, the cylinder housing slot dimensioned to receive the housing edge of the cylinder housing, preventing the cylinder housing from rotation relative to the button, the cam slot arranged for placement of the cam finger, allowing the cam finger to move between the first finger position and the second finger position when the cylinder is caused to rotate, wherein when the wafers are engaged with the wafer slots, the cam is prevented from rotation relative to the button and the cam finger is prevented from moving from the first finger position to the second finger position, and when the wafers are caused to disengage from the wafer slots, the cylinder can be rotate relative to the cylinder housing so as to move the cam finger from the first finger position to the second finger position.

13. The lock according to claim 12, wherein the spindle comprises a spindle head, and the button further comprises an extended wall arranged to contact with the spindle head so as to move the spindle from the first spindle position to the second spindle position.

14. The lock according to claim 8, wherein each of the dials comprises a plurality of indicia for forming a combination code such that when the dials are turned to match the combination code to open the lock, the opening slot of each of the clutches is aligned with the associated extended protrusion of the spindle shaft.

15. The lock according to claim 14, wherein when the opening slot of each of the clutches is aligned with the associated extended protrusion of the spindle shaft, each of the extended protrusions of the spindle is positioned within the opening slot of the associated clutch whether the spindle is positioned in the first spindle position or in the second spindle position, preventing each of the clutches from rotation relative to the spindle shaft, said lock further comprising an end cap positioned adjacent to the stack of clutches, wherein when the spindle is positioned in the first spindle position, the end cap can be caused to move the stack of the clutches relative to the spindle so as to disengage the one or more extended fins of each of the clutches from the indents of the associated dial, so that the dials can be turned independently of the clutches to form a different combination code.

16. The lock according to claim 14, further comprising a lock body and a base plate fastened to the lock body to accommodate the first locking mechanism and the second locking mechanism, wherein each of the clutches further comprises a decode slot formed on an outer surface of the cylindrical body in relationship to the opening slot, and the base plate comprises a plurality of holes, each hole positioned in relationship to one of the decode slots and dimensioned to receive a picking tool so as to allow the picking tool to separately locate the decode slot of each of the clutches when the dials are turned.

17. The lock according to claim 14, wherein each of the clutches further comprises a decode slot formed on an outer surface of the cylindrical body in relationship to the opening slot, said lock further comprising a decode fork having a plurality of finger tips, each finger tip associated with and positioned in relationship to one of the decode slots, and wherein when the latch is caused to move from the first latch position to the second latch position by the second locking mechanism, each of the finger tips is caused to press against the outer surface of the associated clutch so as to allow the finger tips to separately located the decode slot of each of the clutches when the dials are turned.

18. The lock according to claim 14, wherein each of the clutches further comprises an extended finger extended from an outer surface of the cylindrical body in relationship to the opening slot, said lock further comprising a decode fork having a plurality of finger tips, each finger tip associated with and positioned in relationship to one of the extended fingers, and wherein when the latch is caused to move from the first latch position to the second latch position by the second locking mechanism, each of the finger tips is caused to press against the outer surface of the associated clutch so as to allow the finger tips to separately located the extended finger of each of the clutches when the dials are turned.

19. The lock according to claim 3, further comprising a lock body arranged to accommodate the first locking mechanism and the second locking mechanism, the lock body having a lock surface with two locking-latch openings, each locking-latch opening arranged to receive a zipper pull, and wherein said at least one locking member comprises two locking members each having a lock head to engage with one of the zipper pulls.

* * * * *